US007386271B2

(12) United States Patent
Kuwata et al.

(10) Patent No.: US 7,386,271 B2
(45) Date of Patent: Jun. 10, 2008

(54) SHEET PROCESSING APPARATUS AND IMAGE FORMING APPARATUS

(75) Inventors: Takashi Kuwata, Shizuoka-ken (JP); Masayoshi Fukatsu, Shizuoka-ken (JP); Kenichiro Isobe, Shizuoka-ken (JP); Hironobu Ata, Susono (JP); Yasuyoshi Hayakawa, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 316 days.

(21) Appl. No.: 11/087,501

(22) Filed: Mar. 24, 2005

(65) Prior Publication Data

US 2005/0220521 A1 Oct. 6, 2005

(30) Foreign Application Priority Data

Apr. 1, 2004 (JP) ..... 2004-109532
Feb. 4, 2005 (JP) ..... 2005-029807

(51) Int. Cl.
*G03G 15/00* (2006.01)
*B65H 31/32* (2006.01)
*B65H 31/26* (2006.01)

(52) U.S. Cl. ..... 399/407; 399/410

(58) Field of Classification Search ..... 399/407–410; *G03G 15/00; B65H 31/32, 31/26, 31/30*
See application file for complete search history.

(56) References Cited

U.S. PATENT DOCUMENTS 5,021,837 A * 6/1991 Uto et al. ..... 399/405
5,700,006 A 12/1997 Sekiya et al. ..... 271/241
6,206,369 B1 3/2001 Hoshii et al. ..... 271/290
6,302,606 B1 10/2001 Hayakawa et al. ..... 400/625
6,318,718 B1 11/2001 Ogata et al. ..... 271/213
6,325,371 B1 12/2001 Araki et al. ..... 271/297
6,382,614 B1 5/2002 Fukatsu et al. ..... 270/58.11
6,382,616 B1 5/2002 Waragai et al. ..... 270/58.12
6,561,503 B1 5/2003 Ogata et al. ..... 270/58.12
6,581,922 B2 6/2003 Kuwata et al. ..... 270/58.11
6,637,996 B1 10/2003 Hayakawa et al. ..... 412/9
6,674,976 B2 1/2004 Sato et al. ..... 399/18
6,733,007 B2 5/2004 Sekiyama et al. ..... 271/65
6,735,415 B2 * 5/2004 Isobe et al. ..... 399/410
6,912,044 B2 6/2005 Sekiyama et al. ..... 355/407
2001/0052666 A1 12/2001 Kuwata et al. ..... 271/3.01
2003/0178761 A1 9/2003 Kuwata et al. ..... 270/58.08
2003/0185612 A1 10/2003 Sekiyama et al. ..... 399/405

(Continued)

FOREIGN PATENT DOCUMENTS

JP 07048064 A * 2/1995

(Continued)

*Primary Examiner*—Daniel J. Colilla
*Assistant Examiner*—'Wynn' Q Ha
(74) *Attorney, Agent, or Firm*—Fitzpatrick, Cella, Harper & Scinto

(57) ABSTRACT

A sheet processing apparatus includes a first intermediate stacking portion which stacks a conveyed sheet and which performs process to the sheet, a stapler which performs process to the sheet on the first intermediate stacking portion, a second intermediate stacking portion which is located on an upstream side in a conveying direction of the stapler and which is capable of temporarily storing the conveyed sheet, and an intermediate roller pair which conveys the sheet on the second intermediate stacking portion to the first intermediate stacking portion. The sheet stacked on the first intermediate stacking portion and the sheet temporarily stored in the second intermediate stacking portion overlap each other.

23 Claims, 20 Drawing Sheets

U.S. PATENT DOCUMENTS

| | | | | |
|---|---|---|---|---|
| 2004/0104528 | A1 | 6/2004 | Fukatsu et al. | 271/207 |
| 2004/0217543 | A1 | 11/2004 | Fukatsu et al. | 271/207 |
| 2004/0256792 | A1 | 12/2004 | Kuwata et al. | 271/207 |
| 2005/0035535 | A1 | 2/2005 | Ogata et al. | 271/220 |
| 2005/0133991 | A1 | 6/2005 | Ata et al. | 271/273 |

FOREIGN PATENT DOCUMENTS

| | | | |
|---|---|---|---|
| JP | 2002-80162 | | 3/2002 |
| JP | 2003081517 A | * | 3/2003 |

* cited by examiner

SHEET PROCESSING APPARATUS AND IMAGE FORMING APPARATUS

BACKGROUND OF THE INVENTION

1. Field of the Invention

The present invention relates to a sheet processing apparatus which processes a sheet and an image forming apparatus equipped with the sheet processing apparatus. In particular, the invention relates to a sheet processing apparatus which can receive and put the next sheet on standby while processing a sheet, and an image forming apparatus equipped with the sheet processing apparatus.

2. Related Background Art

Conventionally, as image forming apparatuses, for example, there are a printer which prints digital information using an electrophotographic technique, and a multifunction printer installing an image reading apparatus together with the printer as a base, thereby being given a multifunction. Some of those printers have a sheet processing apparatus which processes a sheet having an image formed thereon.

Some conventional sheet processing apparatuses have such functions of stacking a sheet discharged from a printer on a sheet stacking portion, performing, for example, stapling process to the sheet, and discharging the sheet thereafter (see Japanese Patent Application Laid-Open No. 2002-80162).

However, the conventional sheet processing apparatus cannot receive a sheet in the next job until the sheet processing apparatus discharges a sheet bundle after starting the stapling process. Therefore, the conventional sheet processing apparatus has a problem in that sheet processing efficiency is lowered in proportion to the number of sheets which cannot be received.

In addition, an image forming apparatus having such a sheet processing apparatus has to bring a printer engine to a standstill state until the sheet processing apparatus receives a sheet. Therefore, the conventional image forming apparatus has a problem in that sheet processing efficiency is low because the image forming apparatus cannot form images on sheets successively.

SUMMARY OF THE INVENTION

It is an object of the present invention to provide a sheet processing apparatus which can receive a sheet even while processing a sheet.

It is another object of the present invention to provide an image forming apparatus which has the sheet processing apparatus, which can receive a sheet in the next job even while processing a sheet in the preceding job, and can form images on the sheets successively.

In order to achieve the above-mentioned objects, the present invention provides a sheet processing apparatus, including: a first intermediate stacking portion which stacks a conveyed sheet and which performs processing to the sheet; an aligning device which moves in a direction intersecting with a sheet conveying direction and which aligns both sides of the sheet on the first intermediate stacking portion; a processing unit which performs process to the sheet aligned by the aligning device; a second intermediate stacking portion which is located on an upstream side in the sheet conveying direction of the first intermediate stacking portion and which is capable of temporarily storing the conveyed sheet during sheet processing on the first intermediate stacking portion; and a conveying rotary member which conveys the sheet on the second intermediate stacking portion to the first intermediate stacking portion, wherein: an end on the upstream side in the sheet conveying direction of the sheet stacked on the first intermediate stacking portion and an end on a downstream side in the sheet conveying direction of the sheet temporarily stored in the second intermediate stacking portion overlap each other; and the aligning device is disposed on the downstream side in the sheet conveying direction from an area where the sheet on the first intermediate stacking portion and the sheet temporarily stored in the second intermediate stacking portion overlap each other.

In the sheet processing apparatus of the present invention, a sheet stacked on the first intermediate stacking portion and a sheet stacked on the second intermediate stacking portion are laid one on top of another. Thus, the sheet processing apparatus can receive and store following sheets and can improve sheet processing efficiency. In addition, it is possible to reduce a size of the sheet processing apparatus because sheets are laid one on top of another.

In the sheet processing apparatus of the present invention, the sheet width aligning means for aligning both sides of a sheet on the first intermediate stacking portion, is disposed on a downstream side in the sheet conveying direction of an area where a sheet stacked on the first intermediate stacking portion and a sheet stacked on the second intermediate stacking portion are laid one on top of another. Thus, the sheet processing apparatus can align only the sheet on the first intermediate stacking portion.

The image forming apparatus of the present invention includes the sheet processing apparatus which can receive and store following sheets. Thus, the image forming apparatus can form images on sheets successively and can improve image forming efficiency.

BRIEF DESCRIPTION OF THE DRAWINGS

FIGS. 10A, 10B and 10C are diagrams for explaining an alignment operation and a binding operation of the sheet post-processing apparatus, in which FIG. 10A is a diagram of the sheet post-processing apparatus at the time when a sheet is stacked on a first intermediate stacking portion, FIG. 10B is a diagram of the sheet post-processing apparatus at the time when a sheet bundle is stacked on the first intermediate stacking portion, and FIG. 10C is a diagram of the sheet post-processing apparatus at the time when a sheet in the next job is delivered during binding process operation of a stapler;

FIGS. 11A, 11B and 11C are diagrams for explaining an operation of discharging a sheet bundle of the preceding job and an operation of aligning a sheet bundle of the next job in the sheet post-processing apparatus, in which FIG. 11A is a diagram of the sheet post-processing apparatus at the time when the sheet bundle of the preceding job is discharged, FIG. 11B is a diagram of the sheet post-processing apparatus at the time when the sheet bundle of the preceding job is dropped on a sheet stacking tray, and FIG. 11C is a diagram of the sheet post-processing apparatus at the time when a sheet bundle of the next job is aligned;

FIGS. 13A and 13B are diagrams of a pressing and holding apparatus, in which FIG. 13A is a diagram of the pressing and holding apparatus at the time when the pressing and holding apparatus holds a sheet bundle and FIG. 13B is a diagram of the pressing and holding apparatus at the time when the pressing and holding apparatus releases the held sheet bundle;

FIGS. 17A, 17B and 17C are diagrams for explaining an operation of discharging a sheet bundle subjected to staple processing in a first intermediate stacking portion 300B in a state in which a sheet is stacked on a second intermediate stacking portion 300C in the sheet post-processing apparatus shown in FIG. 15, in which FIG. 17A is a diagram of the sheet post-processing apparatus at the time when a sheet in the next job is delivered during a binding process operation of a stapler, FIG. 17B is a diagram of the sheet post-processing apparatus at the time when the sheet post-processing apparatus is delivering a sheet bundle of the preceding job, and FIG. 17C is a diagram of the sheet post-processing apparatus immediately before the sheet post-processing apparatus drops the sheet bundle of the preceding job on a sheet stacking tray;

DESCRIPTION OF THE PREFERRED EMBODIMENTS

A sheet post-processing apparatus serving as a sheet processing apparatus and an image forming apparatus according to embodiments of the present invention will be hereinafter explained with reference to the accompanying drawings.

(Image Forming Apparatus)

Figure 1:
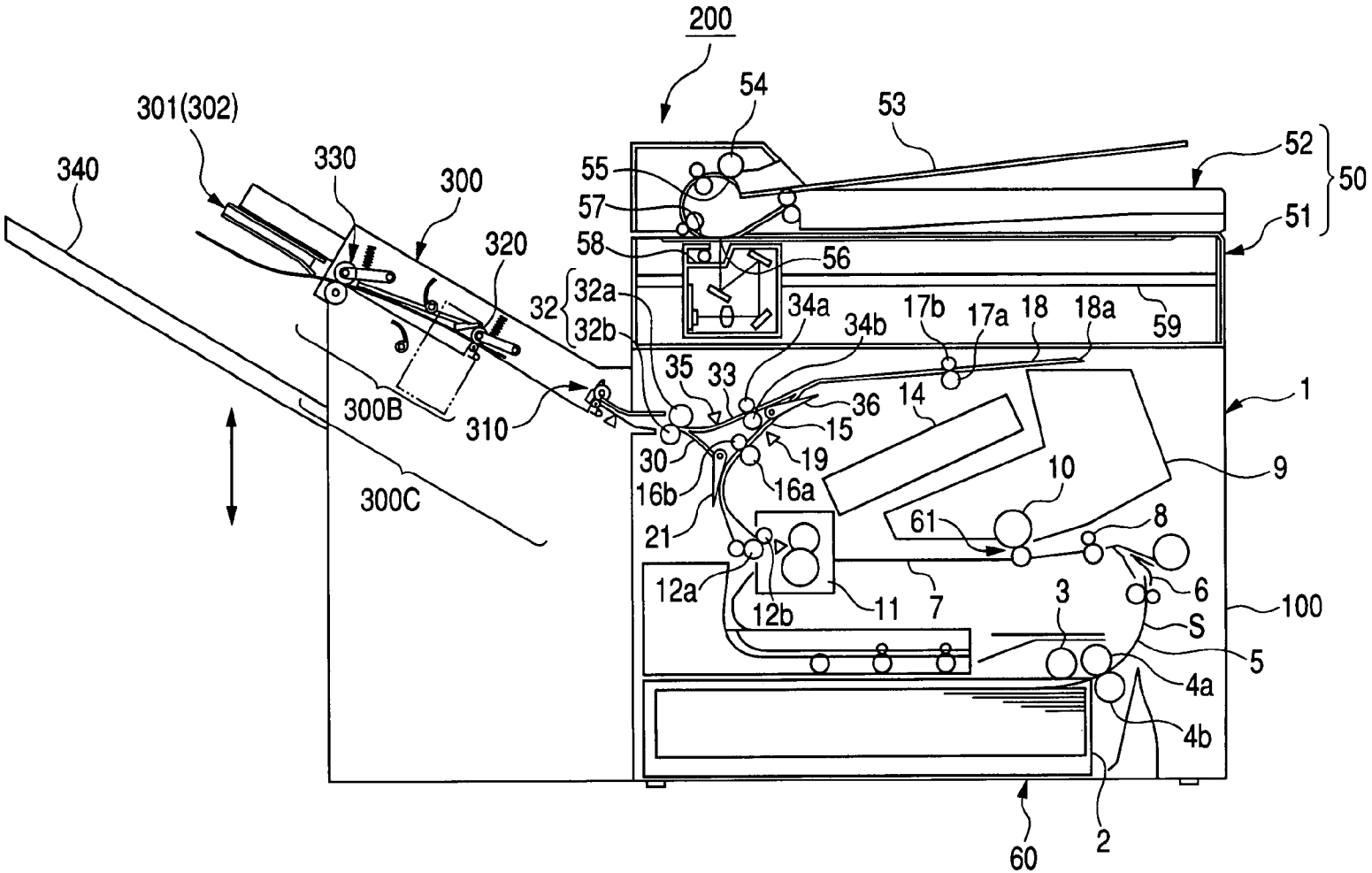
FIG. 1 is a sectional view taken along a sheet conveying direction of an image forming apparatus according to an embodiment of the present invention.
Figure 3:
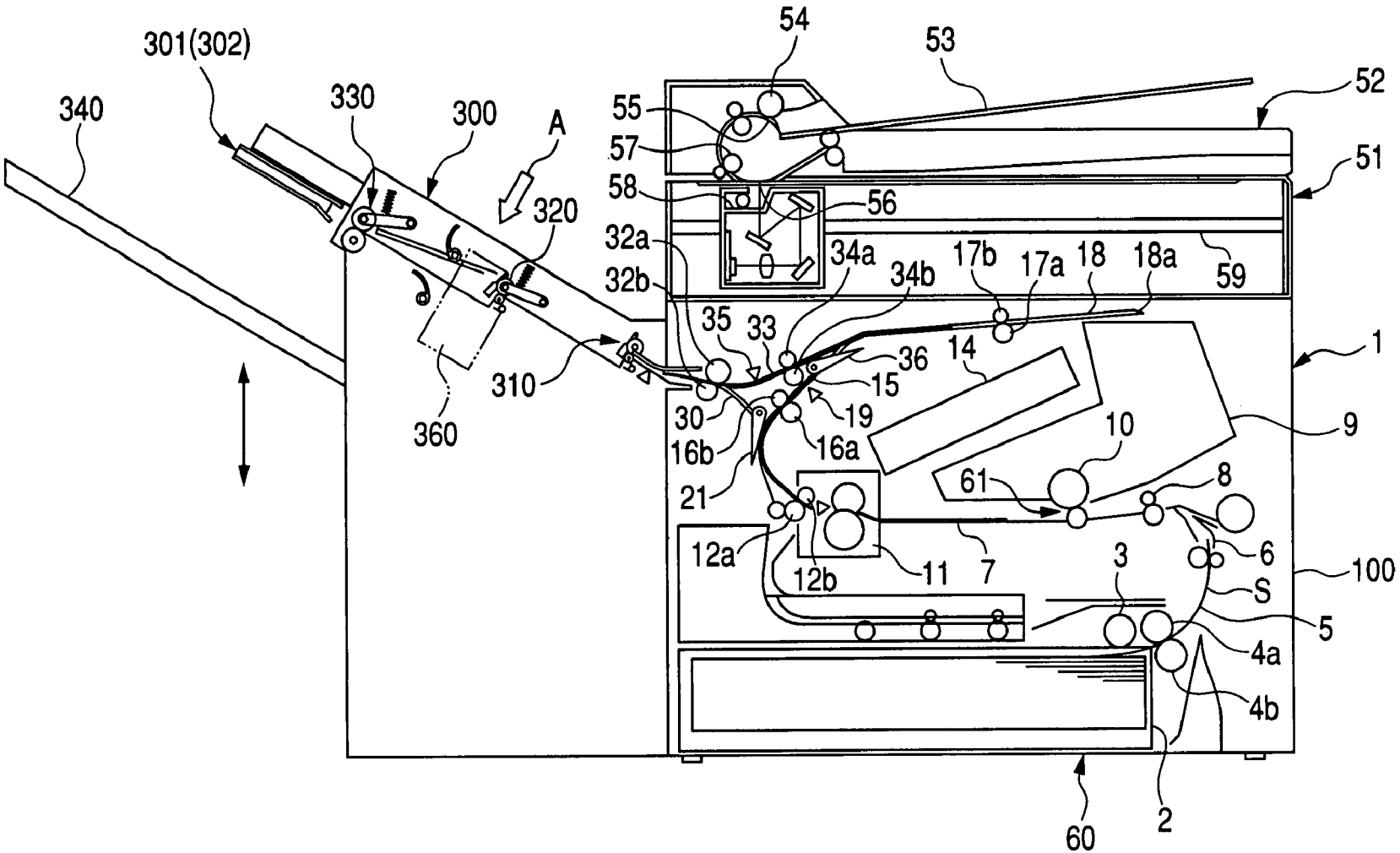
FIG. 3 is a diagram for explaining a sheet conveying operation in the image forming apparatus in FIG. 1.

FIGS. 1 and 3 are sectional views taken along a sheet conveying direction of an image forming apparatus 200 in which a sheet post-processing apparatus 300 is connected to a printer unit 1 according to a first embodiment of the present invention. Note that, the sheet post-processing apparatus 300 is often connected to a main body 100 of the printer unit 1 serving as an optional unit, the printer unit 1 and the sheet post-processing apparatus 300 of the first embodiment can also operate independently. As the image forming apparatus, there are a copying machine, a printer, a facsimile, a complex machine of the copying machine, the printer, and the facsimile, and the like.

The printer unit 1 and the sheet post-processing apparatus 300 are incorporated in separate housings. However, the printer unit 1 and the sheet post-processing apparatus 300 may be incorporated in a signal housing.

Second, third, and fourth sheet post-processing apparatus 370, 380, and 390 can also be connected to the main body 100 of the printer unit 1 instead of the sheet post-processing apparatus 300 of the first embodiment.

Sheet post-processing apparatuses of the respective embodiments perform process for binding a sheet bundle with a stapler. However, the sheet post-processing apparatuses may perform punching process, pasting process, and the like. In other words, process for a sheet in the sheet processing apparatus of the present invention is not limited to stapling process.

The image forming apparatus 200 includes a printer unit 1, which forms an image on a sheet in an electrophotographic process, as an image treating unit. A feeding cassette 2 constituting a sheet feeding portion 60, a feeding roller 3 which delivers sheets from the feeding cassette 2, separating and conveying rollers 4*a* and 4*b* which separate the delivered sheets one by one, and the like are disposed in a lower part of the printer unit 1.

A sheet delivered from the feeding cassette 2 of the sheet feeding portion 60 are conveyed to an image forming portion 61 serving as image forming means through conveying paths 5 and 6, a registration roller 8, and the like. The image forming portion 61 includes an image forming process unit (hereinafter referred to as "cartridge") 9 having a photosensitive drum 10 and the like. In this embodiment, the image forming portion 61 exposes an image read by a scanner 14 on the photosensitive drum 10, forms a toner image with a publicly known electrophotographic process, and transfers and forms this toner image on the conveyed sheet.

The sheet, on which the toner image is formed, is conveyed through a conveying path 7 and heated and pressed in a heat-fixing device 11 to have the toner image fixed thereon. Then, the sheet is delivered to the sheet post-processing apparatus 300 by a fixing and discharging roller 12*a* and a fixing and discharging runner 12*b* as well as an upper discharging roller 32*a* and a lower discharging roller 32*b*.

An image reading unit 50 is arranged above the printer unit 1. As shown in FIG. 1, the image reading unit 50 includes a scanner unit 51 and an automatic document feeder (hereinafter referred to as "ADF") 52. The ADF 52 separates and conveys plural originals stacked on an original stacking tray 53 one by one with a feeding roller 54 and a separating pad 55, causes the originals to pass through an original reading position 56, and causes the scanner unit 51 to optically read information written on the originals. In addition, the ADF 52 can open to the rear around a hinge (not shown) provided in the rear part of the apparatus. Thus, a user can open the ADF 52 when the user places an original on an original plate (platen) 57.

The scanner unit 51 has a general structure in which an optical carriage 58 reads information written on an original placed on the original plate (platen) 57 while scanning the original in a lateral direction along a guide shaft 59 and photoelectrically converts the information with a CCD. In reading the original with the ADF 52, the optical carriage 58 stops in a predetermined position to read an original to be delivered. Note that a detailed explanation of the scanner unit is omitted here.

The printer unit 1 has two conveying paths 15 and 30 in order to deliver a sheet to the sheet post-processing apparatus 300. The first conveying path 15 is a path for switching back and conveying a sheet to a portion above the writing scanner 14 from the pair of the fixing and discharging roller 12*a* and the fixing and discharging runner 12*b*, reversing and conveying the sheet, and discharging the sheet to the sheet post-processing apparatus 300. The second conveying path 30 is a path for discharging a sheet from the heating and fixing device 11 to the sheet post-processing apparatus 300 directly.

FIG. 3 shows a state in which a sheet S is conveyed through the first conveying path 15. Switching to the first conveying path 15 is realized by an FD/FU flapper 21 which is provided on a downstream side in the sheet conveying direction of the fixing and discharging roller 12*a* and runner 12*b* (hereinafter simply referred to as "downstream side"). A converging roller 16*a* and a converging roller 16*b* are provided in a middle part of the first conveying path 15 on the downstream side of the FD/FU flapper 21. A reversing roller 17*a* and a reversing runner 17*b* are provided above the image forming portion 61.

The reversing roller 17*a* and the reversing runner 17*b* can reverse the sheet conveying direction in order to feed a sheet to a third conveying path 33 described later. A draw-in conveying path 18 is formed on the downstream side of the reversing roller 17*a* and the reversing runner 17*b*. An end 18*a* of the draw-in conveying path 18 forms a wraparound conveying path shape to prevent a leading edge of the sheet passes above the cartridge 9 to stick out to the outside of the machine. A sheet detecting sensor 19 is provided in a middle part of the first conveying path 15.

The second conveying path 30, which discharges a sheet to the sheet post-processing apparatus 300 directly, is switched by the FD/FU flapper 21 to guide the sheet to the sheet post-processing apparatus 300 through the upper discharging roller 32*a* and the lower discharging roller 32*b*. In this case, the sheet is guided with an image forming side up (in a face-up state).

A conveying roller 34*a*, a conveying roller 34*b*, and a sheet detecting sensor 35 are provided in a middle part of the third conveying path 33 connecting the reversing roller 17*a*, the reversing runner 17*b*, the upper discharging roller 32*a*, and the lower discharging roller 32*b*.

A reversing flapper 36 is provided near a converging portion of the first conveying path 15 and the third conveying path 33 in front (on the upstream side) of the reversing roller 17*a* and the reversing runner 17*b*. The reversing flapper 36 is always biased so as to block the first conveying path 15. For example, a force for biasing the reversing flapper 36 may be set smaller such that the reversing flapper 36 is pushed and opened by a conveying force of a sheet. Alternatively, the conveying paths may be switched by a solenoid or the like at a given timing. A sheet, which is delivered to the sheet post-processing apparatus 300 through the first conveying path 15 and the third conveying path 33, is delivered with the image forming side down (in a face-down state).

Reversing timing for a sheet will be explained. For example, when the sheet detecting sensor 19 detects a leading edge or a trailing edge of a sheet conveyed through the first conveying path 15 and the trailing edge of the sheet passes the FD/FU flapper 21 by a predetermined amount, the pair of the reversing roller 17*a* and the reversing runner 17*b* rotate in a reverse direction. Then, the reversing roller 17*a* and the reversing runner 17*b* guide the trailing edge of the sheet to the third conveying path 33 and cause the conveying roller 34*a* and the conveying roller 34*b* to receive the sheet by a predetermined amount or for a predetermined time. Thereafter, the sheet is delivered to the sheet post-processing apparatus 300 through the upper discharging roller 32*a* and the lower discharging roller 32*b*.

When the trailing edge of the sheet passes the reversing flapper 36 and moves by a predetermined amount, the sheet changes a direction to enter the third conveying path 33. Then, the sheet is conveyed through the conveying roller 34*a*, the conveying roller 34*b*, the upper discharging roller 32*a*, and the lower discharging roller 32*b* and delivered to the sheet post-processing apparatus 300.

(Sheet Post-processing Apparatus of the First Embodiment)

Figure 2:
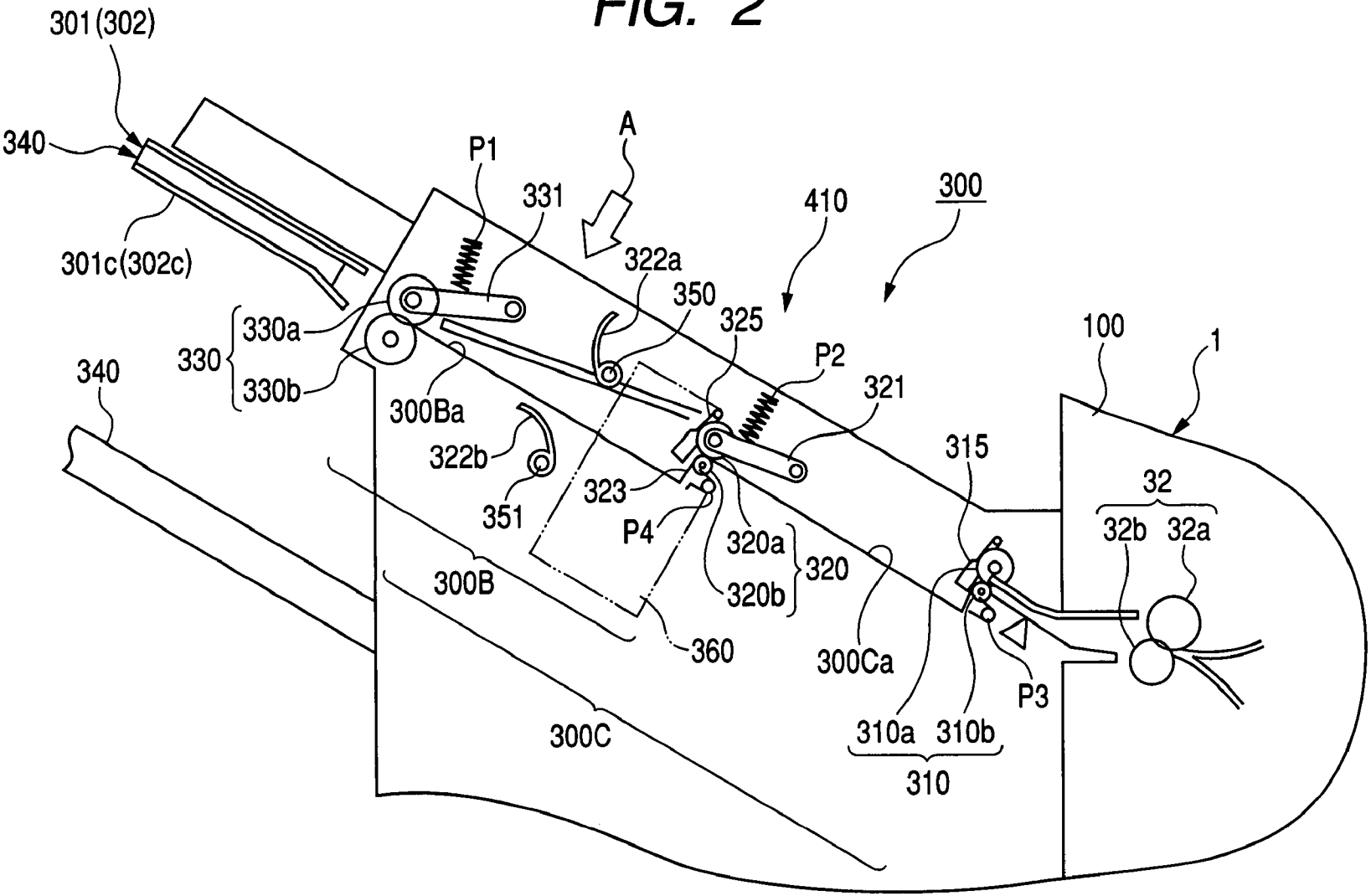
FIG. 2 is a sectional view taken along a sheet conveying direction of a sheet post-processing apparatus serving as a sheet processing apparatus according to a first embodiment of the present invention.
Figure 4:
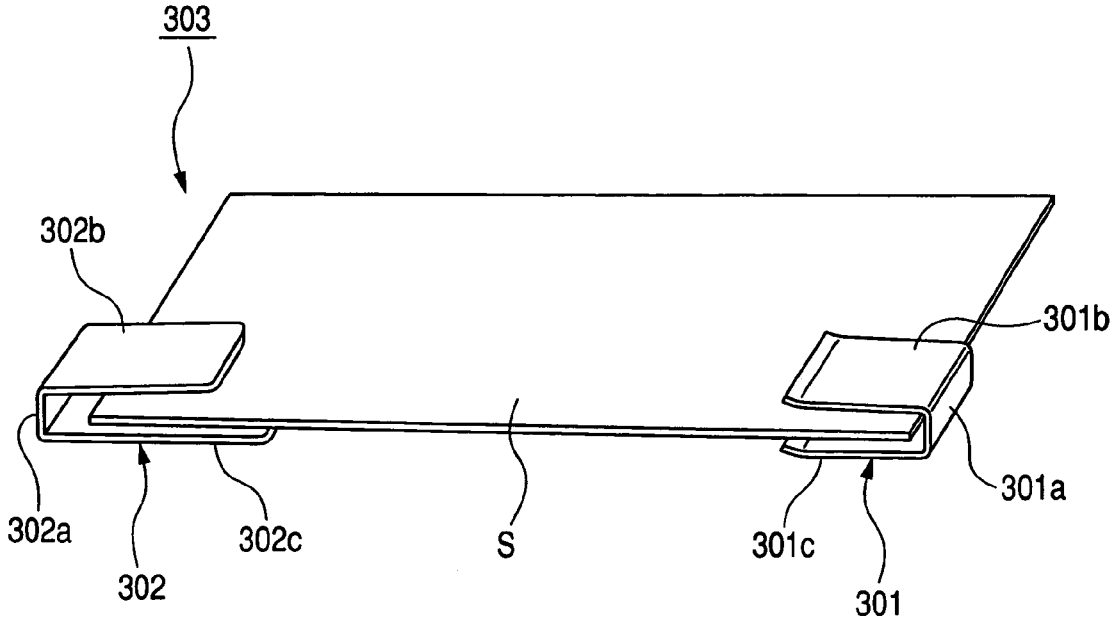
FIG. 4 is a perspective view of a slide guide.
Figure 5:
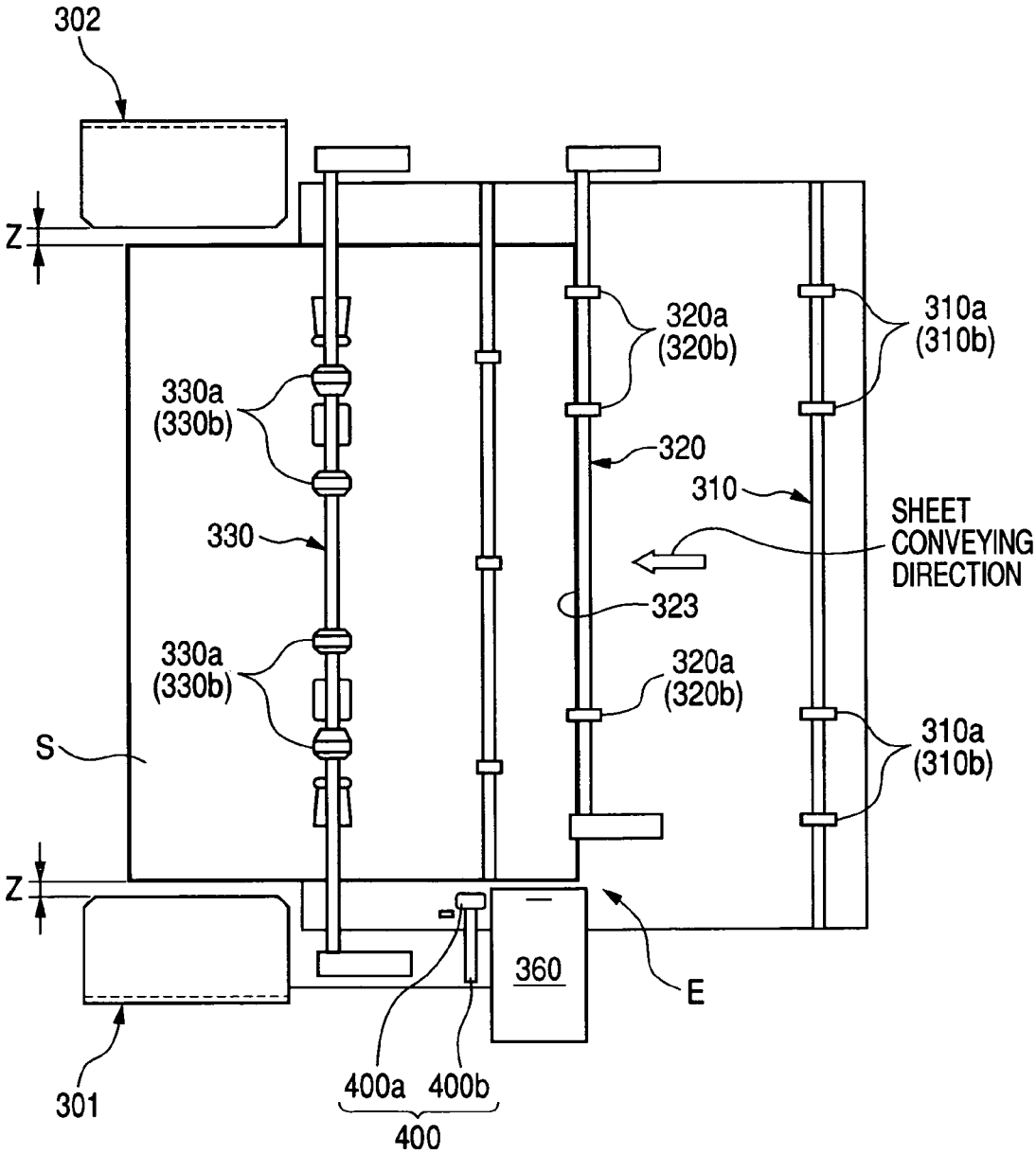
FIG. 5 is a plan view of the sheet post-processing apparatus in FIG. 3 viewed from a direction indicated by the arrow A.

FIG. 2 is a sectional view taken along a sheet conveying direction of the sheet post-processing apparatus 300 of the first embodiment serving as a sheet processing apparatus. FIG. 4 is a perspective view of a slide guide. FIG. 5 is a plan view of the sheet post-processing apparatus 300 viewed from a direction indicated by the arrow A in FIG. 3. The sheet post-processing apparatus 300 includes a receiving roller pair 310 serving as an upstream conveying rotary member pair, a holding flag 315, an intermediate roller pair 320 serving as conveying means, a holding flag 325, a reference wall 323, a stapler 360 serving as processing means, an upper paddle 322*a* serving as an upper surface returning member and returning means, a lower paddle 322*b* serving as a lower surface returning member and returning means, a discharging roller pair 330 serving as discharging means, a sheet width aligning device 303, and a sheet stacking tray 340 serving as a sheet stacking portion. The reference wall 323 serving as conveying direction positioning means, the upper paddle 322*a*, the sheet width aligning device 303 serving as sheet width aligning means, and the like constitute positioning means.

The receiving roller pair 310 receives a sheet conveyed from the upper discharging roller 32*a* and the lower discharging roller 32*b* of the printer unit 1. The receiving roller pair 310 is formed by a receiving roller 310*a* and a receiving roller 310*b* which is pressed against the receiving roller 310*a* by means of a spring P3 and rotated along with the rotation of the receiving roller 310*a*. The holding flag 315 is provided downstream of the receiving roller pair 310. The holding flag 315 is turned in abutment against the conveyed sheet to regulate the trailing edge of the sheet to a position lower than a nip position of the receiving roller pair 310. The intermediate roller pair 320 is provided downstream of the receiving roller pair 310. The intermediate roller pair 320 is composed of an intermediate roller 320*a* axially supported by an arm 321 biased by a spring P2 and an intermediate roller 320*b* which is pressed against the intermediate roller 320*a* by means of a spring P4 and rotated along with the rotation of the intermediate roller 320*a*. The reference wall 323 is provided downstream of the intermediate roller pair 320. The reference wall 323 is used as a positioning reference position for the trailing edge (an upstream end) of the sheet which has passed the intermediate roller pair 320. The holding flag 325 regulates the trailing edge of the sheet, which is brought into abutment against the reference wall 323, to a position lower than a nip position of the intermediate roller pair 320. The stapler 360 binds a sheet bundle with staples. The upper paddle 322*a* rotates to come into abutment against an upper surface of the sheet and brings the sheet into abutment against the reference wall 323 to align the sheet conveying direction. The lower paddle 322*b* rotates to come into abutment against a lower surface of the sheet and brings the sheet into abutment against the reference wall 323 to align the sheet conveying direction. The discharging roller pair 330 is composed of a discharging upper roller 330*a* axially supported by an arm 331 biased by a spring P1 and a discharging lower roller 330*b* which contacts the discharging upper roller 330*a* and is rotated along with the rotation of the discharging upper roller 330*a*. The discharging roller pair 330 is a so-called comb-teeth-like roller pair in which plural rollers are provided on a shaft at intervals. Thus, it is possible to give the sheet stiffness and discharge the sheet to the sheet stacking tray 340, improve alignment precision of a sheet on the sheet stacking tray 340, and make it easy to stack a sheet. The sheet width aligning device 303 has slide guides 301 and 302 serving as a pair of support portions which are moved in a direction perpendicular to the sheet conveying direction by a jogger motor (not shown) at the time of a staple job to support and align a sheet. The sheet stacking tray 340 moves upwards and downwards with the discharged sheet stacked thereon.

Note that, in the structure described above, the receiving roller pair 310, the holding flag 315, the intermediate roller pair 320, the holding flag 325, the reference wall 323, the stapler 360, the upper paddle 322*a*, the lower paddle 322*b*, the discharging roller pair 330, and the sheet width aligning device 303 are collectively referred to as a first sheet stacking portion 410. The sheet stacking tray 340 is referred to as a second sheet stacking portion (see FIG. 2). The first sheet stacking portion 410 includes a first intermediate stacking portion 300B which stacks a sheet and performs process to the sheet and a second intermediate stacking portion 300C which temporarily stores a predetermined number of sheets from the top sheet of the next job while the process is performed in the first intermediate stacking portion 300B. In this embodiment, the receiving roller pair 310 is provided in the sheet post-processing apparatus 300. However, it is also possible that the function of the receiving roller pair 310 is given to the discharging roller pair 32 of the image forming apparatus without providing the receiving roller pair 310.

As shown in FIG. 4, the slide guides 301 and 302 of the sheet width aligning device 303 are formed in a U shape in section by sidewalls 301*a* and 302*a* which guide both sides along the sheet conveying direction of a sheet S, supporting pieces 301*c* and 302*c* which support the sheet S, and float preventing pieces 301*b* and 302*b* which prevent the sheet from floating. Opening portions of the slide guides 301 and 302 are opposed to each other. The supporting pieces 301*c* and 302*c* support the sheet S to be discharged to the first sheet stacking portion 410 but do not support a central part in a width direction of the sheet S. In other words, the slide guides 301 and 302 support both the sides along the sheet conveying direction of the sheet S.

The sheet post-processing apparatus 300 in this embodiment can staple (bind) a sheet bundle and discharge and stack the sheet bundle on the second sheet stacking portion (the sheet stacking tray) 340. The sheet post-processing apparatus 300 can simply discharge and stack the sheet bundle on the second sheet stacking portion 340 in the face-down state in which an image forming side of a sheet is set to face downward or the face-up state in which the image forming side is set to face upward.

First, an operation of simply discharging and stacking a sheet on the second stacking portion 340 in the face-down state will be explained.

As shown in FIG. 5, the slide guide 301 on the front side with respect to the sheet conveying direction and the slide guide 302 on the back side with respect to the sheet conveying direction are retracted in positions where the supporting pieces 301*c* and 302*c* shown in FIG. 4 do not come into abutment against the sheet S to be conveyed, that is, positions in which the supporting pieces 301*c* and 302*c* do not support the sheet S and in which the supporting pieces 301*c* and 302*c* are outside from both edges of the sheet by a predetermined amount Z in a width direction of the sheet S.

Therefore, a sheet, which is not processed but is simply discharged and stacked on the second stacking portion 340 in the face-down state, is passed to the sheet post-processing apparatus 300 from the discharging roller pair 32 of the printer unit 1 of the image forming apparatus 200 by the receiving roller pair 310 and passes the intermediate roller pair 320. Then, the sheet passes near the stapler 360, falls from the discharging roller pair 330 toward the second sheet stacking portion 340, and is stacked on the second sheet stacking portion 340.

Next, an operation of stapling the sheet S and discharging and stacking the sheet S on the second stacking portion 340 will be explained with reference to FIGS. 4 to 14.

Figure 6:
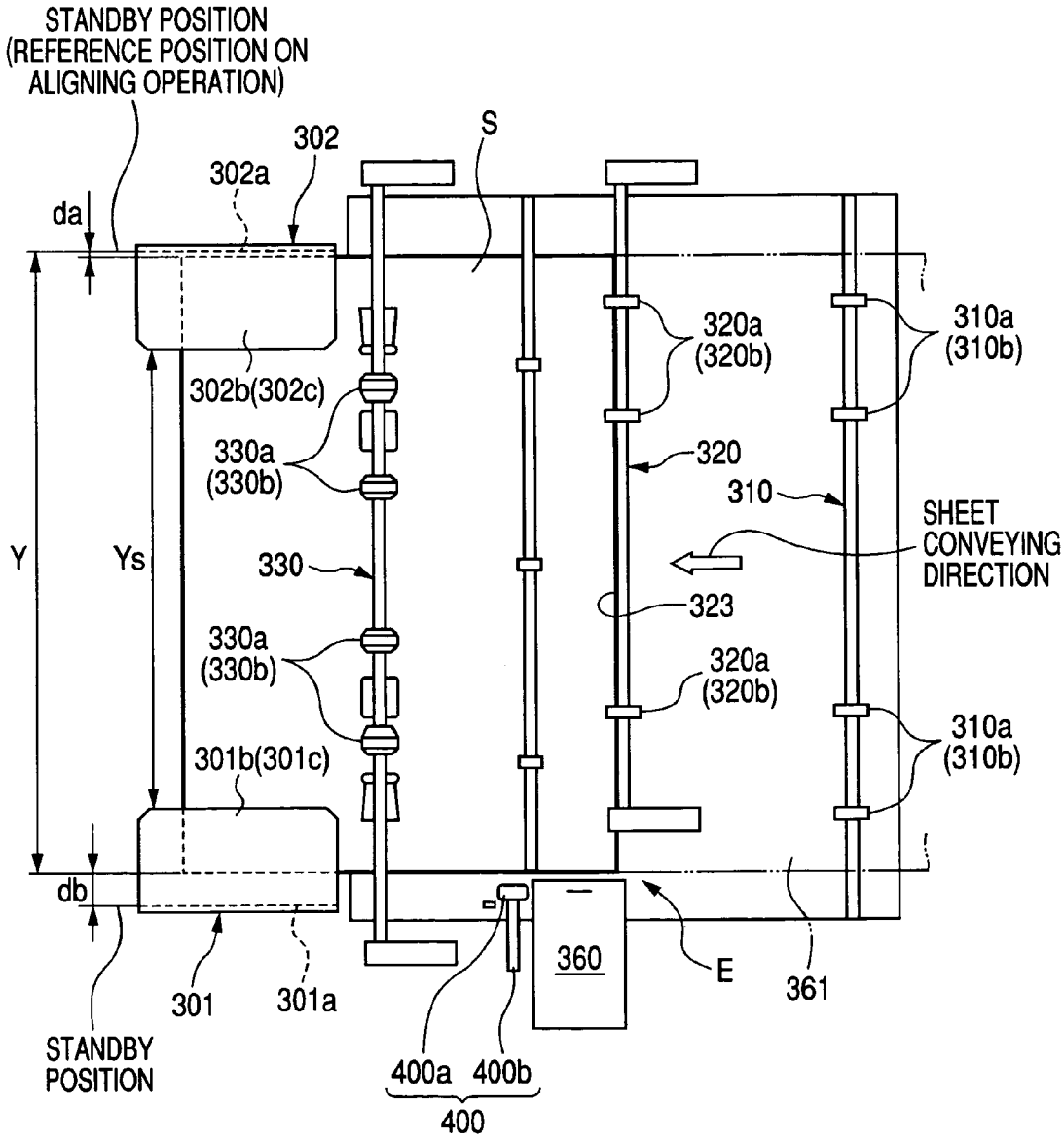
FIG. 6 is a plan view of the sheet post-processing apparatus at the time when a slide guide of the sheet post-processing apparatus is in a standby position.

When a signal indicating that the sheet S enters the sheet post-processing apparatus 300 is inputted from the main body 100 (see FIG. 9) of the printer unit 1, the jogger motor (not shown) rotates and both the slide guide 301 on the front side and the slide guide 302 on the back side shown in FIG. 5 move to the inner side (directions in which the slide guides come closer to each other). As shown in FIG. 6, the slide guides 301 and 302 stop in outer positions from the edges of the entering sheet S by predetermined amounts da and db. This position will be hereinafter referred to as a standby position. Note that, in the standby position, the sidewall 301*a* of the slide guide 301 is a reference position at the time of an aligning operation.

Here, in the sheet post-processing apparatus 300 in this embodiment, the standby position of the slide guides 301 and 302 is set such that, even when a widthwise size of the sheet S is a maximum allowable size for passing, gaps on both sides of the sheet S correspond to the predetermined amounts da and db. Note that, when a sheet with a width smaller than the width of the sheet described above is aligned, the slide guide 302 moves to the front side by an amount equivalent to a difference between the widths such that, for example, a gap on the left side in the standby position as a first position shown in FIG. 6 always corresponds to the predetermined amount da.

Since the sheet post-processing apparatus 300 is in a staple mode, as shown in FIG. 6, an interval Ys between end faces of the supporting pieces 301*c* and 302*c* of the slide guides 301 and 302 is smaller than a width Y of the sheet S. Since the two slide guides 301 and 302 are in such a position, the slide guides 301 and 302 can support the entering sheet S.

Figure 10A:
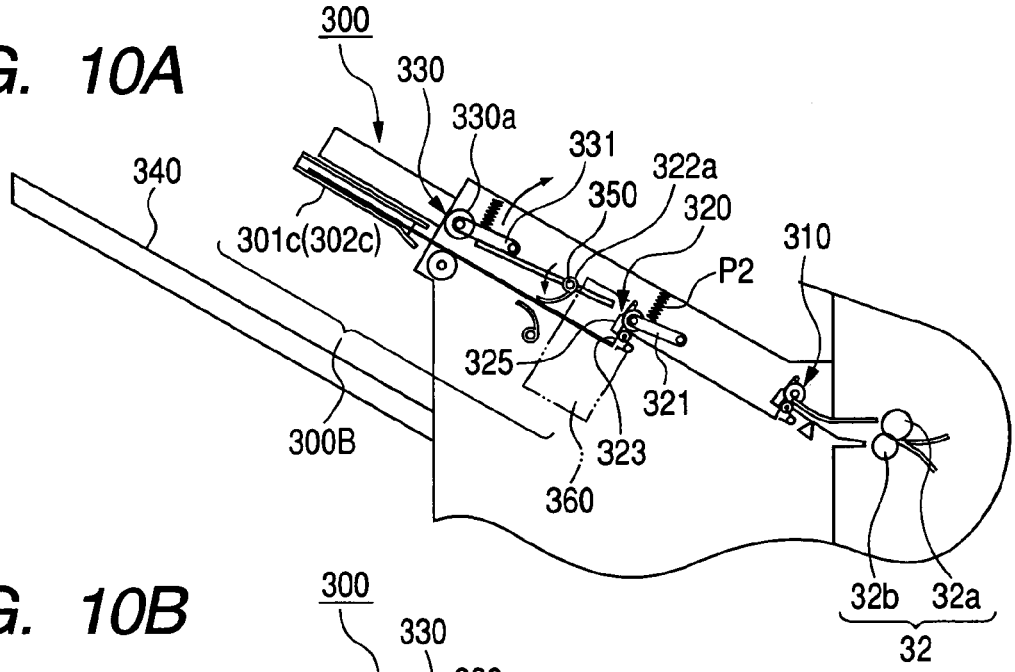

As shown in FIG. 10A, the first sheet S conveyed from the discharging roller pair 32 of the printer unit 1 is conveyed to an entrance of the sheet post-processing apparatus 300. The sheet S is conveyed onto the sheet supporting pieces 301*c* and 302*c* of the slide guides 301 and 302 by the receiving roller pair 310, the intermediate roller pair 320, and the discharging roller pair 330. In this process, the sheet S comes into abutment against the holding flags 315 and 325 to turn the holding flags 315 and 325 in a clockwise direction. Note that the holding flags 315 and 325 are biased in a counterclockwise direction in FIGS. 10A, 10B, and 10C by means of springs (not shown).

Immediately after the first sheet S is conveyed onto a surface formed by the slide guides 301 and 302 in this way, as shown in FIG. 10A, the arm 331 is turned in the clockwise direction and the discharging upper roller 330*a* axially supported by the arm 331 retracts in an upward direction. As a result, a nip portion of the discharging roller pair 330 is not formed.

Consequently, the first intermediate stacking portion 300B is defined by a sheet conveying path from the reference wall 323 to the discharging roller pair 330 (excluding the intermediate roller pair 320), the discharging roller pair 330 not forming a nip portion, and the sheet supporting pieces 301*c* and 302*c* of the slide guides 301 and 302 in the position shown in FIG. 6.

Simultaneously with this, a driving force for the discharging upper roller 330*a* and the discharging lower roller 330*b* is cut off to stop rotation of the rollers. When the trailing edge of the sheet S passes through the intermediate roller pair 320 completely, a position in a height direction of the trailing edge of the sheet S is regulated to a position lower than the nip position of the intermediate roller pair 320 by the holding flag 325. Then, the sheet S returns in a direction opposite to the conveying direction under its own weight and moves to approach the reference wall 323. Since the trailing edge of the sheet S is regulated to a position lower than the nip position of the intermediate roller pair 320, a sheet to be conveyed next never gets under the sheet already stacked to change an order of pages.

Figure 12:
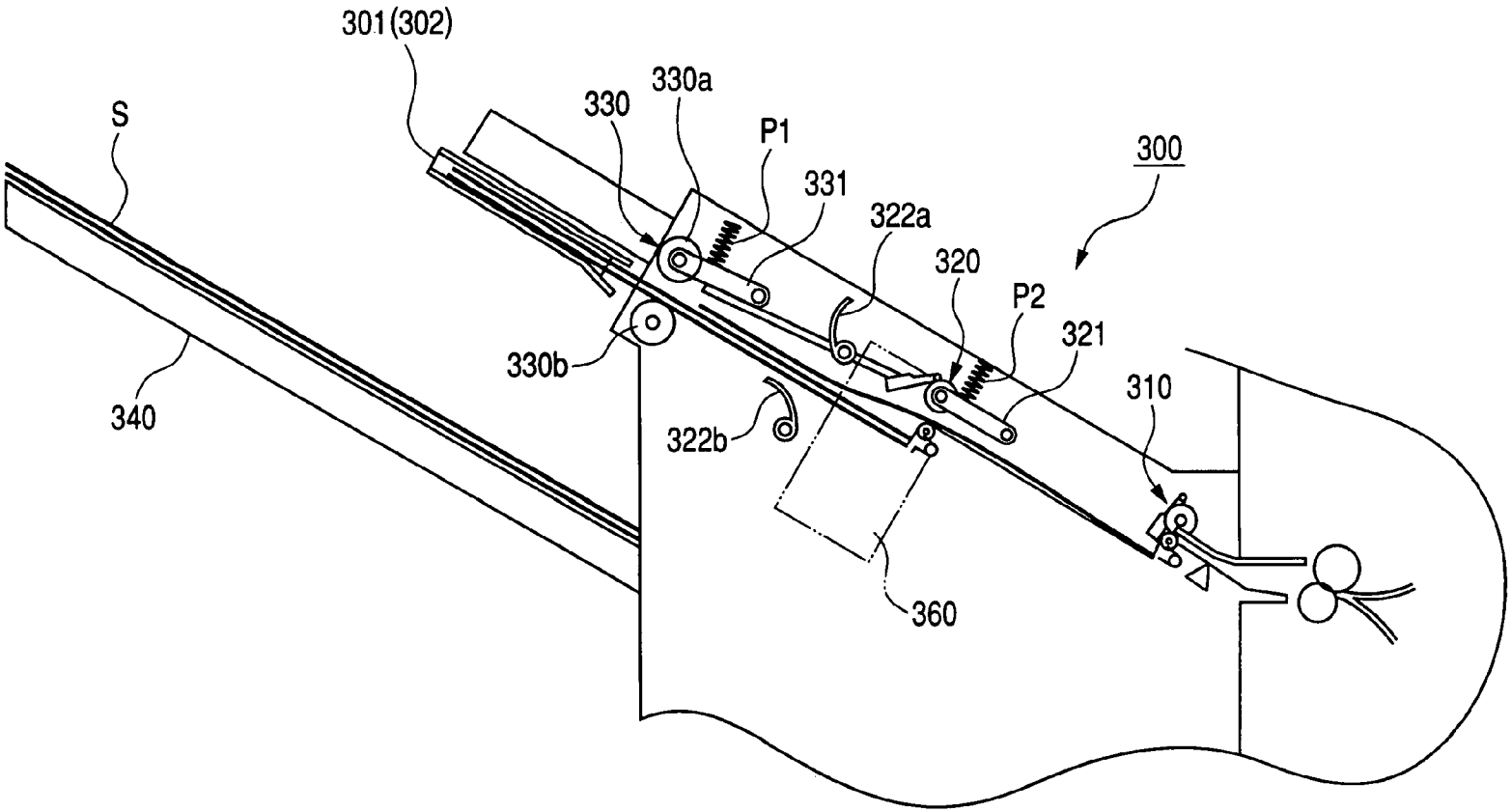
FIG. 12 is a diagram illustrative of a state in which a sheet in the next job is received in the state shown in FIG. 11C.

As shown in FIG. 12, in this embodiment, a sheet in the next job stacked on the second intermediate stacking portion 300C described later is temporarily stored so as to partially overlap a sheet already stacked on the first intermediate stacking portion 300B. It is possible to reduce a dimension in the sheet conveying direction of the sheet post-processing apparatus 300 by constituting the first sheet stacking portion 410 as described above. This contributes to a reduction in a size of the apparatus.

Note that, as shown in FIG. 2, a sheet stacking surface 300Ca of the second intermediate stacking portion 300C is in a position higher than a sheet stacking surface 300Ba of the first intermediate stacking portion 300B across the reference wall 323 serving as a step.

Figure 7:
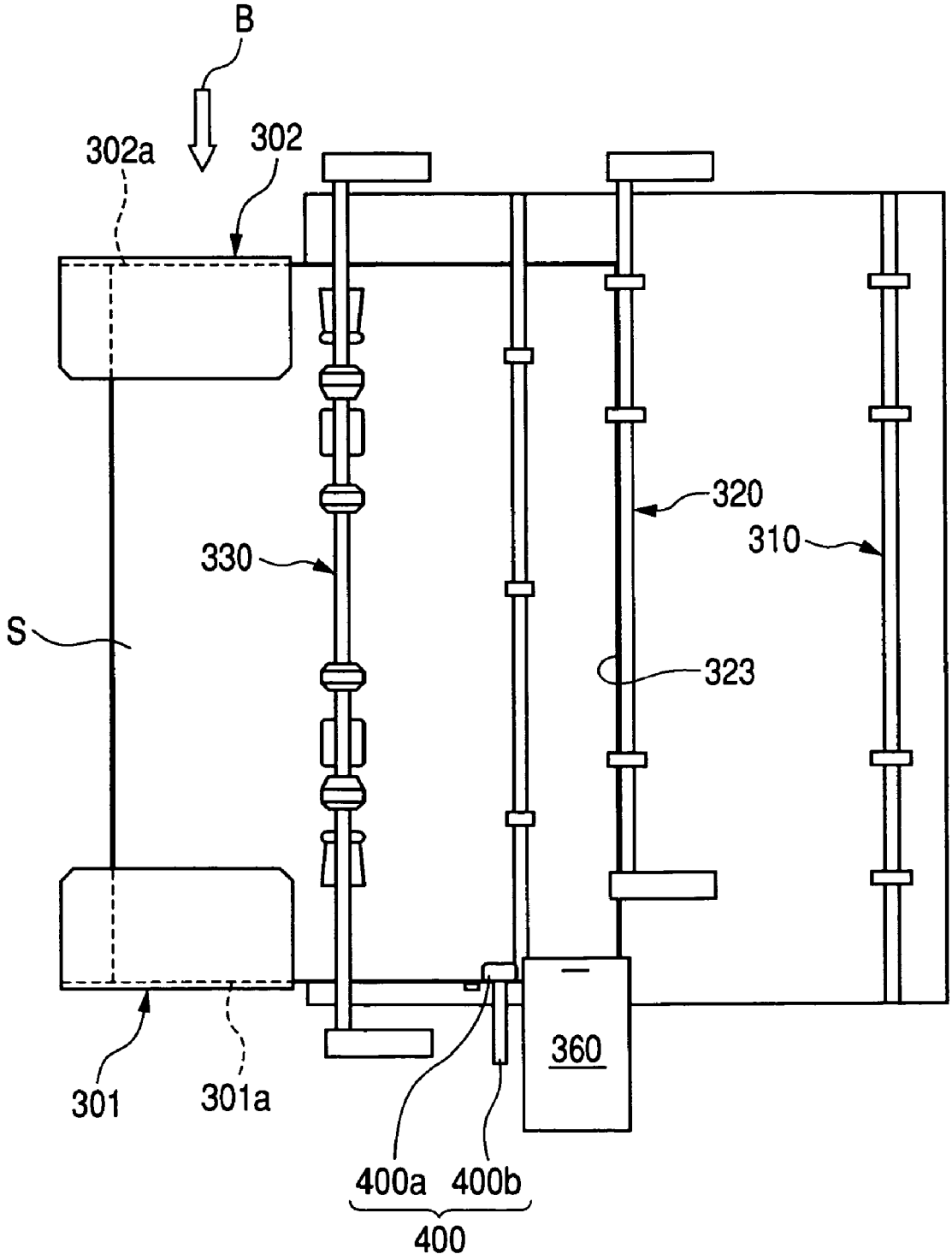
FIG. 7 is a plan view of the sheet post-processing apparatus at the time when the slide guide of the sheet post-processing apparatus performs width alignment for a sheet.

Next, as shown in FIG. 7, only the slide guide 302 on the back side moves in a direction indicated by the arrow B and an operation for alignment in the width direction of the sheet S stacked on the first intermediate stacking portion 300B is started. Specifically, the slide guide 302 on the back side is moved in the direction indicated by the arrow B by the motor (not shown), whereby the sidewall 302*a* of the slide guide 302 on the back side comes into abutment against an edge on the left side of the sheet S to push the sheet S toward the slide guide 310 on the front side. The sheet S is moved into a frontage (between a driver and a clincher) of the stapler 360 by the operation. Note that the edge on the left side of the sheet means an edge on the left side, provided that the upstream side is viewed from the downstream side of the sheet conveying direction.

Figure 8:
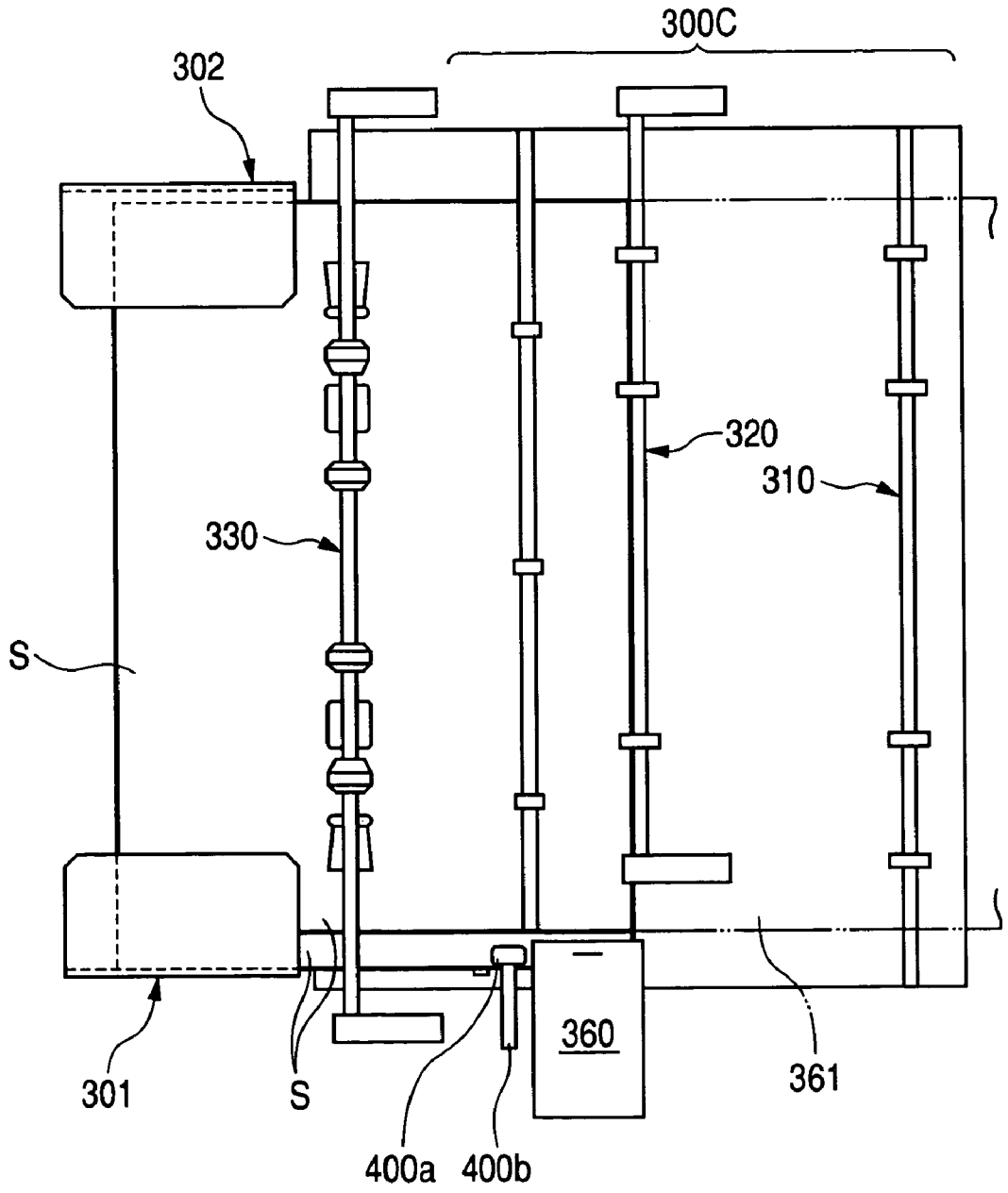
FIG. 8 is a plan view of the sheet post-processing apparatus at the time when a sheet in the next job is delivered.
Figure 9:
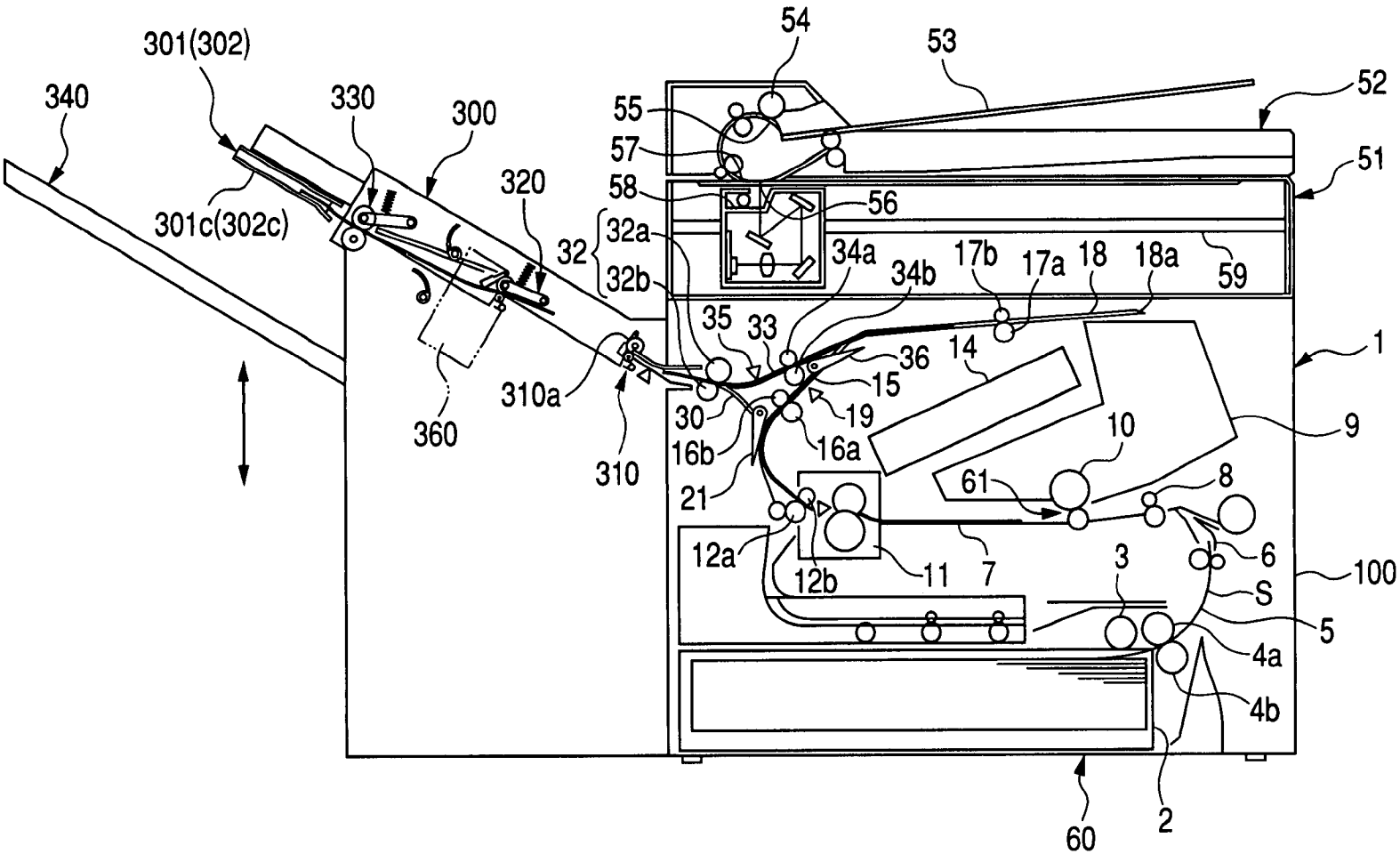
FIG. 9 is a diagram for explaining a sheet conveying operation in the image forming apparatus in FIG. 1.
Figure 14:
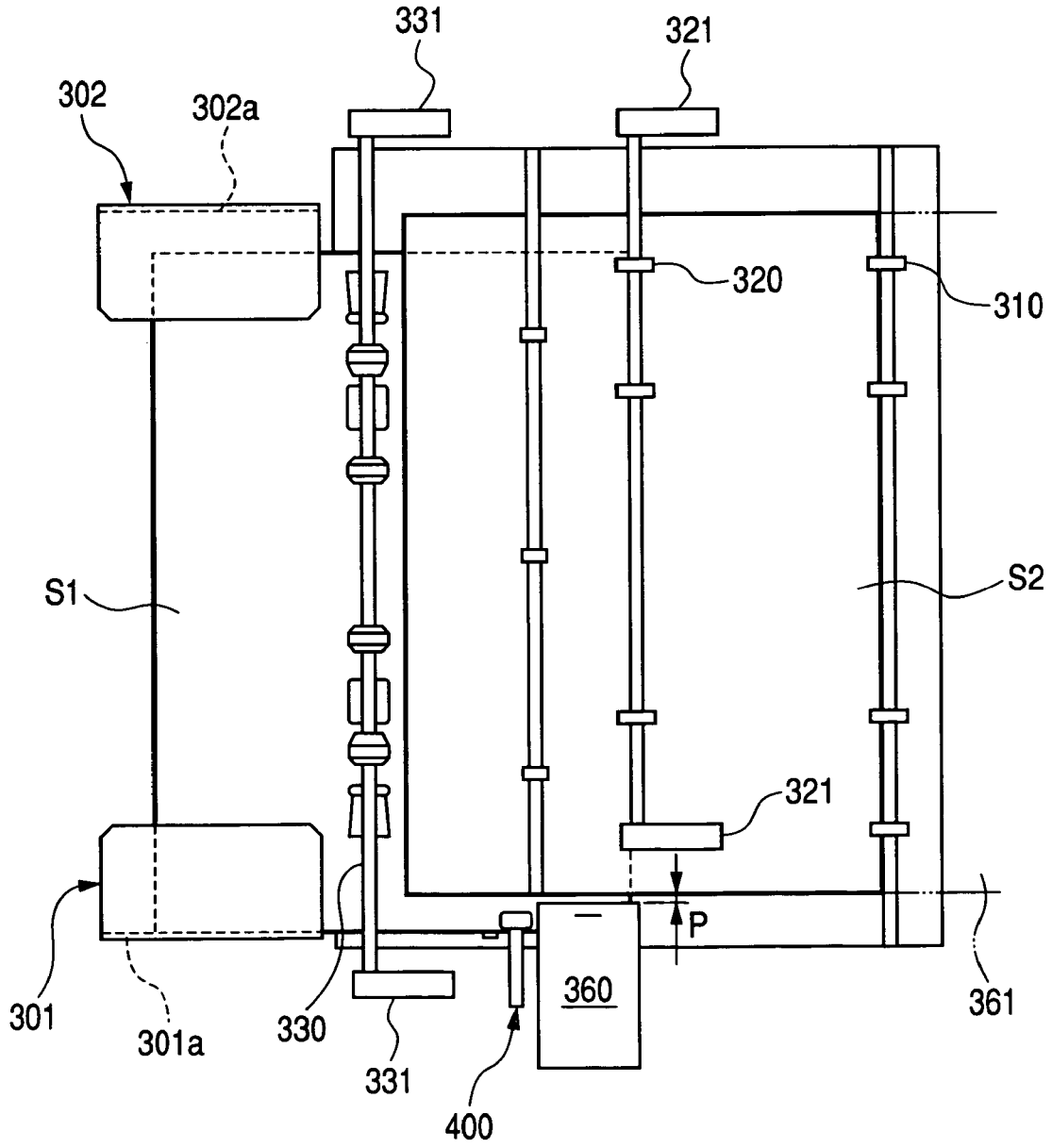
FIG. 14 is a plan view illustrative of a state in which a sheet in the next job is delivered when a sheet in the preceding job is in a binding position.

When an edge on the right side of the sheet S comes into abutment against the sidewall 301*a* of the slide guide 301 on the front side, the alignment in the width direction of the sheet is completed. The edge on the right side of the sheet means an edge on the right side, provided that the upstream side is viewed from the downstream side of the sheet conveying direction. As shown in FIGS. 8 and 14, the sheet aligned in this way shifts form a conveying area 361 of a sheet, which is conveyed by the receiving roller pair 310 and the intermediate roller pair 320, in a direction intersecting with the sheet conveying direction by a predetermined amount. An alignment position of the sheet is set in a position E where the sheet is stapled with the stapler 360. The slide guides 301 and 302 are provided in an area on the downstream side of the first intermediate stacking portion 300B where a sheet on the second intermediate stacking portion 300C and a sheet on the first intermediate stacking portion 300B do not overlap each other. Thus, it is possible to align only the sheet on the first intermediate stacking portion 300B.

In this way, as shown in FIG. 14, the stapler 360 is disposed in a position a distance P apart from the sheet conveying area 361. As shown in FIGS. 8 and 14, the position E where a sheet is stapled (a sheet processing position) is set outside the sheet conveying area 361. This aims to, when the stapler 360 staples a sheet bundle of the preceding job described later, prevent the stapler 360 from stapling a sheet in the next job being delivered together with the sheet bundle in the preceding job by mistake. Note that the stapler is explained as the sheet post-processing apparatus in this embodiment. However, for example, when punching means is adopted as the sheet post-processing apparatus for punching process, if the punching means is arranged to perform the punching process to a leading edge side of the preceding sheet, the preceding sheet is never processed together with a sheet in the next job.

After the alignment operation, the slide guide 302 on the back side moves in a direction in which the distance between the slide guides 301 and 302 becomes larger than the width of the sheet S. In the standby position, again, the slide guide 302 waits for the next sheet to be conveyed.

Figure 10B:
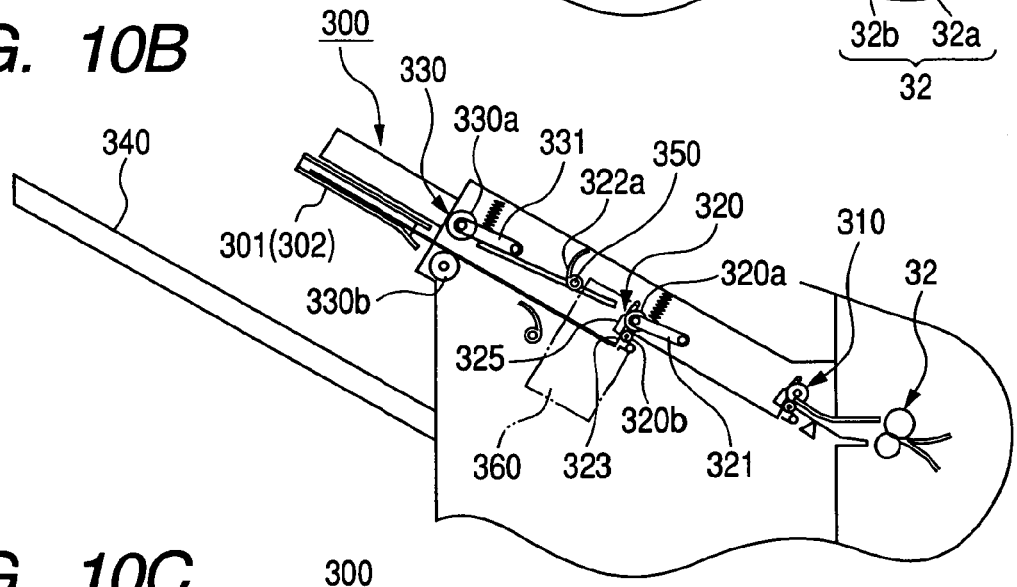

As shown in FIG. 4, after performing the alignment in the width direction of the sheet, the slide guides 301 and 302 retract slightly to the outer side to ease the regulation in the alignment direction of the sheet S such that the sheet S can move in the sheet conveying direction. Thereafter, as shown in FIGS. 10A and 10B, the upper paddle 322*a* rotates once in the counterclockwise direction around a paddle shaft 350 while coming into abutment against the upper surface of the sheet S to bring the upstream end (the trailing edge) of the sheet S into abutment against the reference wall 323 and align the trailing edge of the sheet S. The sheet is aligned at the upstream side end in the sheet conveying direction exactly by the reference wall 323.

Figure 13A:
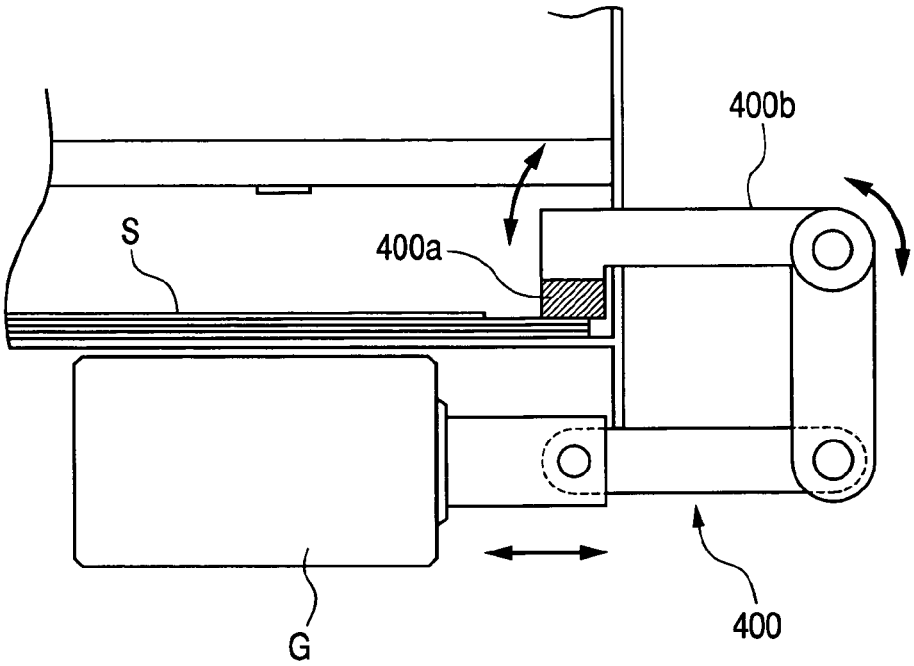
Figure 13B:
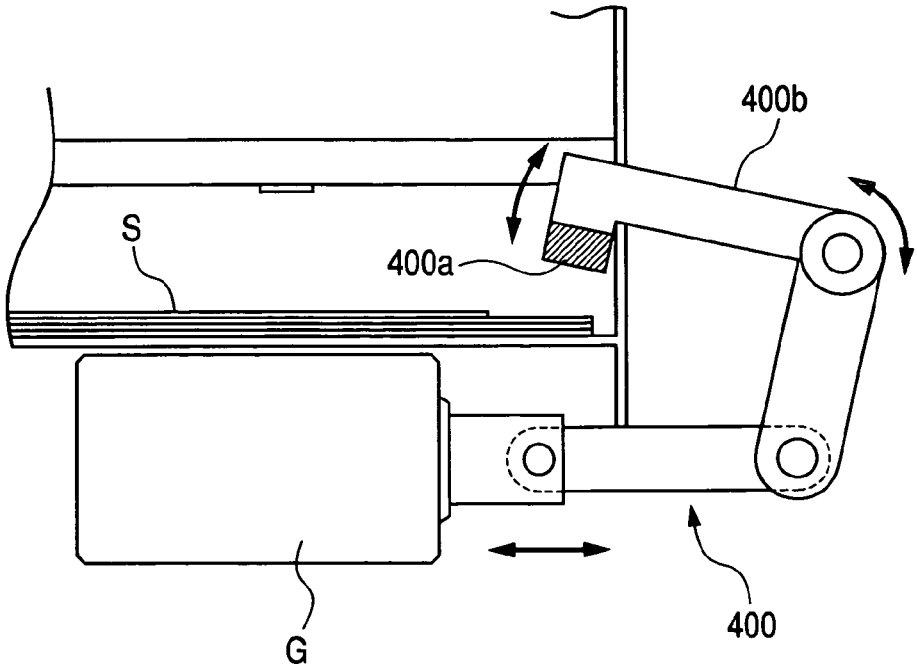

With the operation described above, the alignment in the sheet conveying direction and the width direction of the first sheet is completed. Note that, in order to keep the aligned state, as shown in FIGS. 5, 13A, and 13B, a pressing and holding apparatus 400 is disposed near a right edge of the sheet in the aligned state. The pressing and holding apparatus 400 includes a lever 400*b* which is turned in an up to down direction by a solenoid G. A friction member 400*a* is provided at a tip end of the lever 400*b*. After the completion of the alignment operation with the slide guides 301 and 302, before a following sheet entering next comes into abutment against the preceding sheet aligned earlier, the pressing and holding apparatus 400 presses an upper surface of the preceding sheet with the friction member 400*a* so as to prevent the preceding sheet from being moved by the following sheet to cause the misalignment. The pressing and holding apparatus 400 presses a part outside the sheet conveying area 361. This is because the lever 400*b*, which holds a sheet, is kept from hindering the conveyance of a following sheet which is conveyed in the sheet conveying area 361.

After the alignment for the first sheet ends in this way, a second sheet is conveyed. When the second and subsequent sheets are conveyed, the discharging roller pair 330 is separated. Thus, when the trailing edge of the sheet S passes through the intermediate roller pair 320 completely, the sheet S returns in a direction opposite to the conveying direction under its own weight and moves to approach the reference wall 323 (see FIG. 10A). Thereafter, in the same manner as the operation shown in FIG. 10A, the upper paddle 322*a* rotates once in the counterclockwise direction around the paddle shaft 350 while coming into abutment against the upper surface of the sheet S. Consequently, the sheet S is brought into abutment against the reference wall 323 and aligned. Note that, since subsequent width aligning operations for the second sheet are completely the same as that for the first sheet, an explanation of the width aligning operation is omitted.

The sheet post-processing apparatus 300 performs such an operation repeatedly to align a last (nth) sheet (Sn) of one job. Then, in a state shown in FIG. 7 and FIGS. 10A to 10C in which the slide guide 302 on the back side brings the edge on the right side of the sheet into abutment against the slide guide 301 on the front side to stop the movement of the slide guide 302 on the back side, the stapler 360 disposed on the right side at the trailing edge of the sheet bundle starts an operation of stapling the trailing edge on the right side of the sheet bundle. It is possible to perform the stapling process while keeping the aligned state by holding the sheet bundle near the stapler 360 with the lever 400*b*.

In the operation described above, during the alignment operation for each sheet, the sheet post-processing apparatus 300 stops the slide guide 301 on the front side in the reference position and moves only the slide guide 302 on the back side to align the right side of each sheet in the reference position on the front side. Thus, it is possible to perform the binding process by the stapler 360, which is fixedly arranged on the slide guide 301 side on the front side, accurately and surely. The width alignment for sheets may be performed for each sheet or may be performed for plural sheets of one job at a time.

Figure 10C:
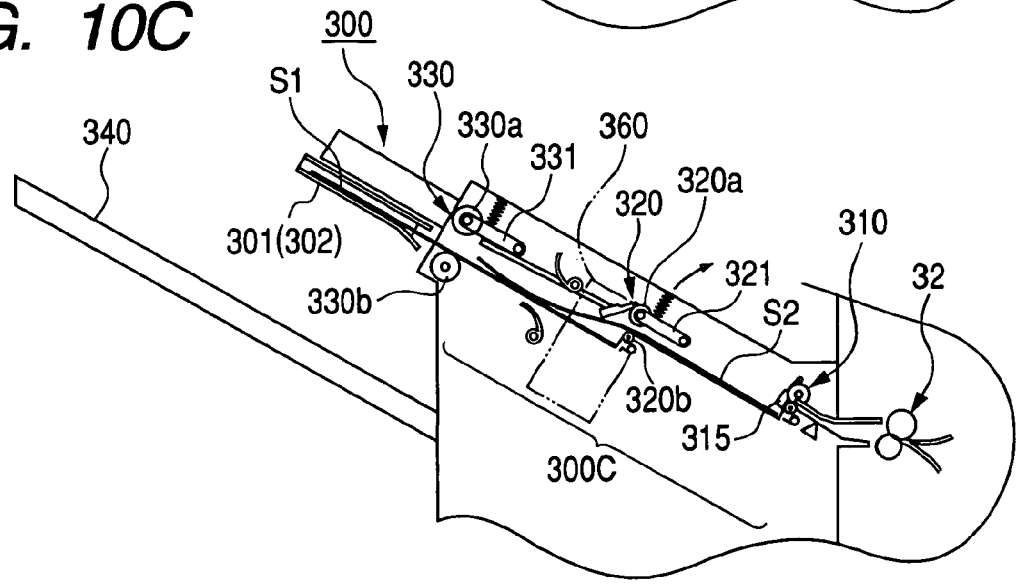

Next, during the binding process operation of the stapler 360, as shown in FIG. 10C, the arm 321 is turned in the clockwise direction and the intermediate roller 320*a* axially supported by the arm 321 separates from the intermediate roller 320*b*. Consequently, in a state in which the intermediate roller pair 320 does not form a nip, the second intermediate stacking portion 300C is formed between the receiving roller pair 310 forming a nip and the vicinity on the upstream side of the discharging roller pair 330 (excluding the discharging roller pair 330). This does not depend on whether the discharging roller pair 330 forms a nip. In addition, this does not depend on whether the slide guides 301 and 302 can support a sheet.

In this state, as shown in FIG. 10C, the sheet post-processing apparatus 300 receives a first sheet S2 of the next job. The first sheet S2 of the next job is conveyed by the receiving roller pair 310. A trailing edge of the sheet S2 passes through the nip of the receiving roller 310. The sheet S2 is temporarily stacked on the second intermediate stacking portion 300C with the trailing edge of the sheet 2 regulated by the holding flag 315.

FIG. 14 is a plan view of a state in which the sheet S2 is stacked on the second intermediate stacking portion 300C. The sheet S2 is in a position away from the stapler 360 in a direction intersecting with the sheet conveying direction. Thus, even if the stapler 360 performs a staple operation, the stapler 360 never binds (staples) the sheet S2 of the next job.

Figure 11A:
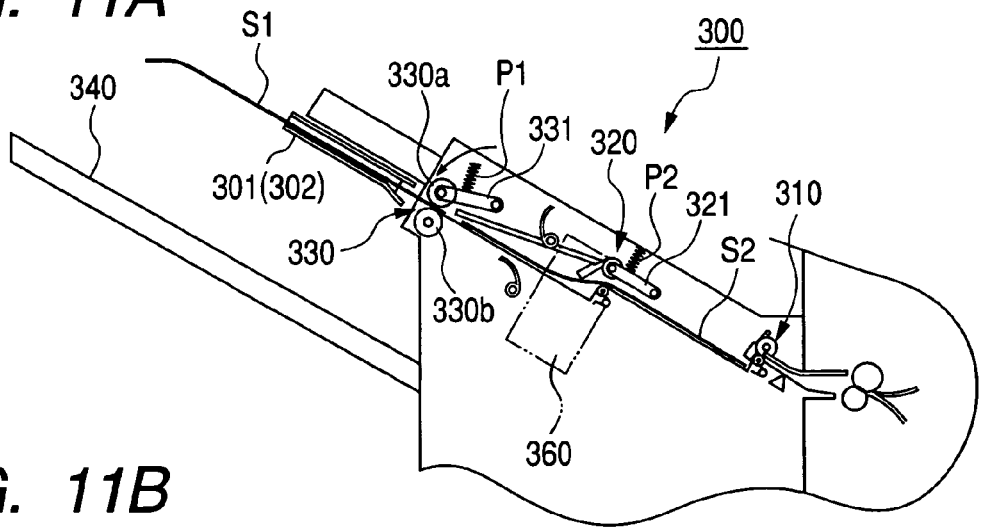

On the other hand, when the staple operation for the sheet bundle S1 of the preceding job ends, as shown in FIG. 11A, the arm 331 rotates in the counterclockwise direction to bring the discharging upper roller 330*a* axially supported by the arm 331 close to the discharging lower roller 330*b* to form the discharging roller pair 300. Then, the discharging upper roller 330*a* and the discharging lower roller 330*b* start rotating. Consequently, the sheet bundle S1 of the preceding job is nipped by the discharging roller pair 330 and conveyed onto the first intermediate stacking portion 300B formed by the slide guides 301 and 302.

When the sheet bundle S1 of the preceding job is discharged from the discharging roller pair 330 completely, the jogger motor (not shown) starts to move both the slide guides 301 and 302 in a direction in which the width between the slide guides 301 and 302 becomes larger than that shown in FIG. 7.

Figure 11B:
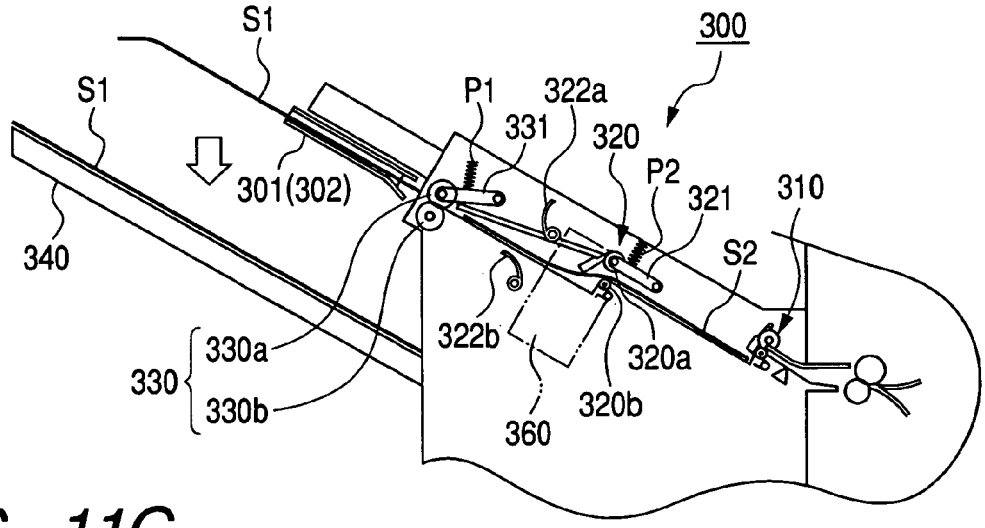

When the interval of both the slide guides 301 and 302 increases to be close to or larger than the width of the sheet, the stapled sheet bundle S1 of the preceding job supported by the slide guides 301 and 302 falls as shown in FIG. 11B and stacked on the sheet stacking portion 340. Note that a position of both the slide guides 301 and 302 at this point is referred to as, for example, a second position as opposed to the first position shown in FIG. 6.

Figure 11C:
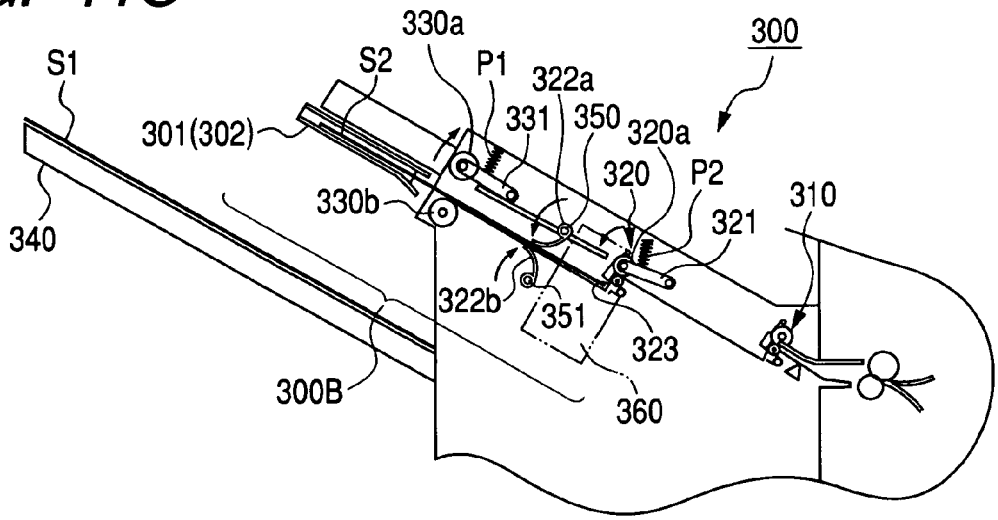

As shown in FIG. 11C, after the sheet bundle S1 of the preceding job is stacked on the sheet stacking portion 340, the arm 331 is turned in the clockwise direction to separate the discharging upper roller 330*a* axially supported by the arm 331 from the discharging lower roller 330*b*. Then, the discharging upper roller 330*a* and the discharging lower roller 330*b* stop rotating.

In addition, the jogger motor rotates and both the slide guide 301 on the front side and the slide guide 302 on the back side move to the inner side (directions in which the slide guides come closer to each other). As shown in FIG. 6, the slide guides 301 and 302 stop in a position where an interval between the slide guides 301 and 302 is wider than the width of the entering sheet S by predetermined amounts da and db.

Consequently, the first intermediate stacking portion 300B is formed again by the sheet conveying path from the reference wall 323 to the discharging roller pair 330, the discharging roller pair 330 not forming a nip, and the sheet supporting pieces 301*c* and 302*c* of the slide guides 301 and 302 in the position shown in FIG. 6.

A second sheet in the next job is stacked on the second intermediate stacking portion 300C by the time when the first intermediate stacking portion 300B is formed. In other words, in FIG. 11B, in a state in which the intermediate roller 320*a* is apart from the intermediate roller 320*b*, a sheet in the next job is delivered by the receiving roller pair 310. The sheet in the next job stops in a position where the conveyance by the receiving roller pair 310 is completed. Then, the sheet is stacked on the second intermediate stacking portion 300C.

In this way, while performing the staple operation for the sheet bundle S1 of the preceding job and the operation of stacking the stapled sheet bundle S1 on the second stacking portion 340, the sheet post-processing apparatus 300 of this embodiment can store the sheet in the next job in the second intermediate stacking portion 300C. Thus, it is possible to perform the stapling process without deteriorating throughput of an engine of the printer unit 1. In addition, as shown in FIG. 12, a sheet on the second intermediate stacking portion 300C and a sheet on the first intermediate stacking portion 300B partially overlap each other, so it is possible to reduce a dimension in the sheet conveying direction and reduce a size of the sheet post-processing apparatus 300.

Thereafter, the arm 321 rotates in the counterclockwise direction, the intermediate roller 320*a* axially supported by the arm 321 is brought into pressed contact with the intermediate roller 320*b*, and a nip is formed in the intermediate roller pair 320. The intermediate roller pair 320 rotates to convey two sheet bundles S2 of the next job to the first intermediate stacking portion 300B. In this embodiment, during process of a sheet in the preceding job on the first intermediate stacking portion 300B, two sheets of the next job are temporarily stored on the second intermediate stacking portion 300C to adjust time. The number of sheets temporarily stacked on the second intermediate stacking portion 300C is changed according to a sheet conveying interval and a time period of sheet processing. In other words, the number of sheets stacked temporarily is set such that a sheet in the next job does not collide against a sheet in the preceding job in a state of being processed and, after the processed sheet bundle is stacked on the second stacking portion 340, the sheet in the next job is conveyed to the first intermediate stacking portion 300B promptly without delay.

Then, as shown in FIG. 7, only the slide guide 302 on the back side moves in a direction indicated by the arrow B and an alignment operation in the width direction for the two sheet bundles S2 stacked on the first intermediate stacking portion 300B is started. Specifically, the slide guide 302 on the back side is moved in the direction indicated by the arrow B by the motor M (not shown), whereby the sidewall 302*a* of the slide guide 302 on the back side comes into abutment against the edge on the left side of the sheets S to push the sheets S2 to the slide guide 301 side on the front side. In this operation, the sheets are moved into the frontage of the stapler 360.

When the edge on the right side of the sheets S comes into abutment against the sidewall 301*a* of the slide guide 301, the alignment in the width direction of the sheets is completed. In this way, a position to which the sheets S are aligned is set in the position E where the sheets S are stapled by the stapler 360. After the alignment operation, the slide guide 302 on the back side moves in a direction in which the width between the slide guides 301 and 302 becomes larger than the width of the sheets S. In the standby position, again, the slide guide 302 waits for the next sheet to be conveyed.

As shown in FIG. 4, after performing the alignment in the width direction of the sheet, the slide guides 301 and 302 retract slightly to the outer side to ease the regulation in the alignment direction of the sheet S such that the sheet S can move in the sheet conveying direction. Thereafter, as shown in FIG. 11C, the upper paddle 322*a* rotates once in the counterclockwise direction around a paddle shaft 350 while coming into abutment against the upper surface of the sheet S on the upper side to bring the upstream end (the trailing edge) of the sheet S on the upper side into abutment against the reference wall 323 and align the trailing edge of the sheet S on the upper side. The lower paddle 322*b* rotates once in the clockwise direction around the paddle shaft 351 while coming into abutment against the lower surface of the sheet on the lower side to bring the sheet into abutment against the reference wall 323 and align the sheet.

With the operation described above, the alignment in the sheet conveying direction and the width direction of the two sheets is performed. Since operations after this are completely the same as those in the preceding job, explanations of the operations are omitted.

After the alignment of the two sheets of the next job ends in this way, a third sheet is conveyed. The third and the subsequent sheets are sequentially conveyed to the first intermediate stacking portion 300B without stopping in the second intermediate stacking portion 300C. When the third and the subsequent sheets are conveyed, the discharging roller pair 330 is separated. Thus, when the trailing edge of the sheet S passes through the intermediate roller pair 320 completely, the sheet S returns in a direction opposite to the conveying direction under its own weight and moves to approach the reference wall 323. Thereafter, in the same manner as the operation shown in FIG. 10A, the upper paddle 322*a* rotates once in the counterclockwise direction around the paddle shaft 350 while coming into abutment against the upper surface of the sheet S. Consequently, the sheet S is brought into abutment against the reference wall 323 and aligned. Note that, since a width aligning operation after this is completely the same as that for the first sheet in the preceding job, an explanation of the width aligning operation is omitted.

The sheet post-processing apparatus 300 performs such an operation repeatedly to align a last (an nth) sheet (Sn) of one job. Then, in a state shown in FIG. 7 and FIGS. 10A to 10C in which the slide guide 302 on the back side brings the edge on the right side of the sheet into abutment against the slide guide 301 on the front side to stop the movement of the slide guide 302 on the back side, the stapler 360 disposed on the right side at the trailing edge of the sheet bundle starts an operation of stapling the right side of the sheet bundle.

When there is a sheet in the next job, while forming the second intermediate stacking portion 300C and performing the staple operation and the operation of stacking the stapled sheet bundle on the second stacking portion 340, the sheet post-processing apparatus 300 can stored the sheet in the next job in the second intermediate stacking portion 300C. Thus, it is possible to perform the stapling process without deteriorating throughput of an engine of the printer unit 1.

When this job is a last job, when the staple operation ends, the arm 331 rotates in the counterclockwise direction to bring the discharging upper roller 330*a* axially supported by the arm 331 close to the discharging lower roller 330*b* to form the discharging roller pair 330. Then, the discharging upper roller 330*a* and the discharging lower roller 330*b* start rotating. Consequently, the sheet bundle S1 is nipped by the discharging roller pair 330 and conveyed onto the first intermediate stacking portion 300B formed by the slide guides 301 and 302.

When the sheet bundle S1 is discharged from the discharging roller pair 330 completely, the jogger motor (not shown) starts to move both the slide guides 301 and 302 in a direction in which the width between the slide guides 301 and 302 becomes larger than that shown in FIG. 7.

When the interval of both the slide guides 301 and 302 increases to be close to or larger than the width of the sheet, the stapled sheet bundle S1 of the preceding job supported by the slide guides 301 and 302 falls as shown in FIG. 11B and stacked on the second sheet stacking portion 340.

As explained above, while the sheet post-processing apparatus 300 in this embodiment performs the staple operation and the operation of stacking the stapled sheet bundle of the preceding job on the second sheet stacking portion 340, at least the intermediate roller 320*a* of the intermediate roller pair 320 among the intermediate roller pair 320 and the discharging roller pair 330 is separated from the intermediate roller 320*b*. Thus, the sheet post-processing apparatus 300 can store the sheet in the next job in the second intermediate stacking portion 300C. Thus, it is unnecessary to stop the engine of the printer unit 1 and decrease printing speed and it is possible to prevent decline in sheet processing efficiency.

Moreover, since a sheet processing position is set outside a sheet conveying area, a following sheet is never bound together with the preceding sheet by mistake.

In addition, in the sheet post-processing apparatus 300 in this embodiment, the first intermediate stacking portion 300B and the second intermediate stacking portion 300C overlap each other. In other words, a post-processing operation is performed in a state in which an upstream side portion of a sheet in the preceding job stacked on the first intermediate stacking portion 300B and a downstream side portion of a sheet in the next job stacked on the second intermediate stacking portion 300C overlap each other. Thus, it is possible to reduce length in the sheet conveying direction and make the sheet post-processing apparatus small in size and inexpensive.

Moreover, in the sheet post-processing apparatus 300 in this embodiment, the lower paddle 322*b* is provided to come into abutment against a lower surface of a sheet to convey the sheet to the upstream side when an upstream end in the sheet conveying direction of the sheet is aligned. Thus, it is possible to improve a matching property of sheets.

Therefore, the present invention can provide the sheet post-processing apparatus 300 in this embodiment which is small in size, inexpensive, and excellent in the matching property while maintaining image forming speed of the engine of the printer unit 1.

(Sheet Post-processing Apparatus in a Second Embodiment)

Figure 15:
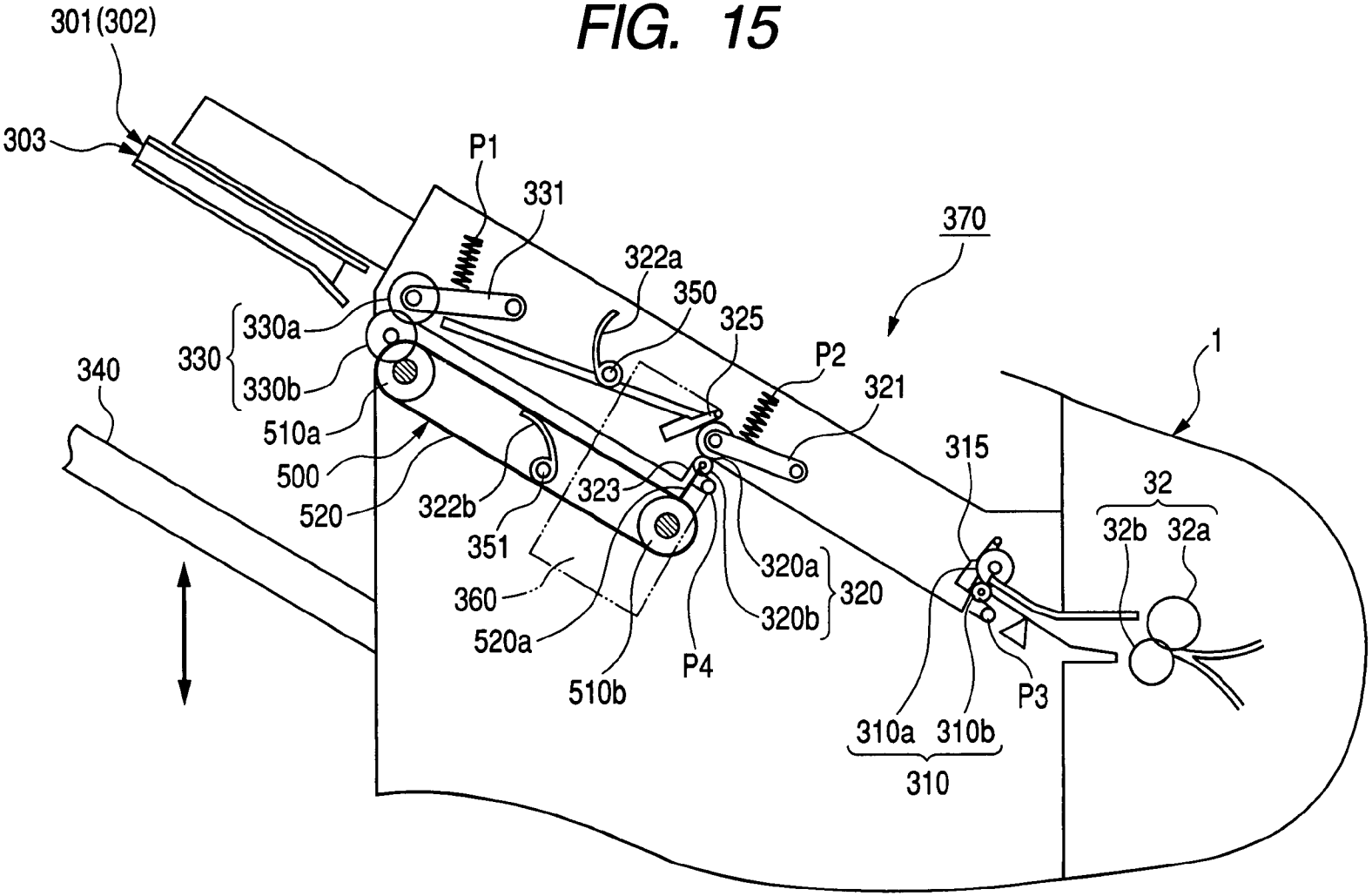
FIG. 15 is a sectional view taken along a sheet conveying direction of a sheet post-processing apparatus according to a second embodiment of the present invention.

FIG. 15 is a sectional view taken along a sheet conveying direction of a sheet post-processing apparatus according to a second embodiment of the present invention.

Figure 17A:
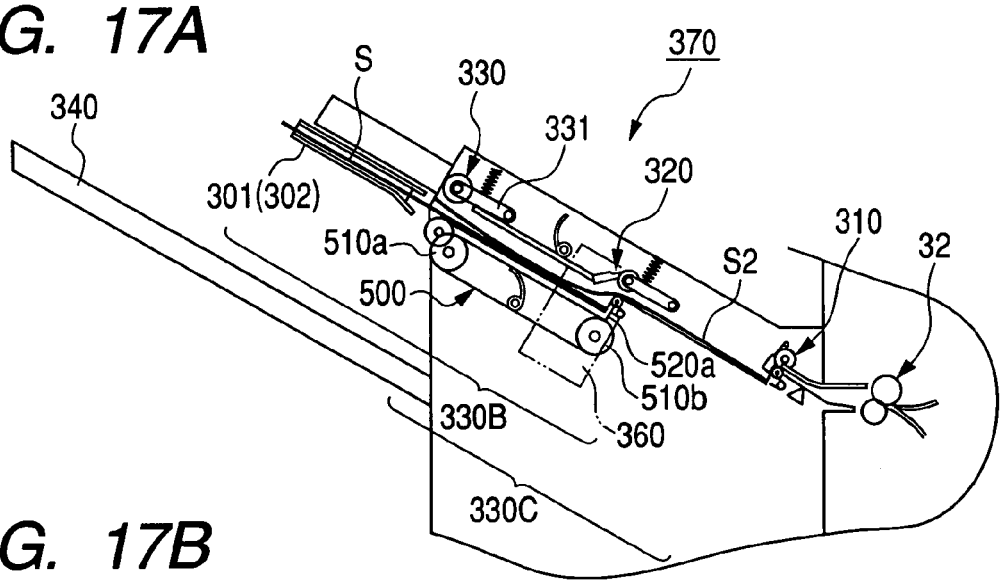

In the sheet processing apparatus 300 in the first embodiment, for example, in FIG. 17A, if a sheet like the sheet S2 of the next job, which has a length equal to or longer than a distance from the receiving roller pair 310 to the discharging roller pair 330, is delivered while the sheet bundle S1 of the preceding job is stapled, when the stapled sheet bundle S1 of the preceding job is discharged by the discharging roller pair 330, the sheet S2 is discharged together with the sheet bundle S1 without being bound.

A sheet post-processing apparatus 370 in the second embodiment solves this problem. The sheet post-processing apparatus 370 includes a sheet bundle discharging device 500 in addition to the components in the sheet post-processing apparatus 300 in the first embodiment. Thus, it is possible to store a sheet in the next job even if the sheet has a length equal to or longer than the distance from the receiving roller pair 310 to the discharging roller pair 330. In the sheet post-processing apparatus 370, components identical with those in the sheet post-processing apparatus 300 in the first embodiment are denoted by the identical reference numerals and symbols and explanations of the components are omitted.

Figure 16:
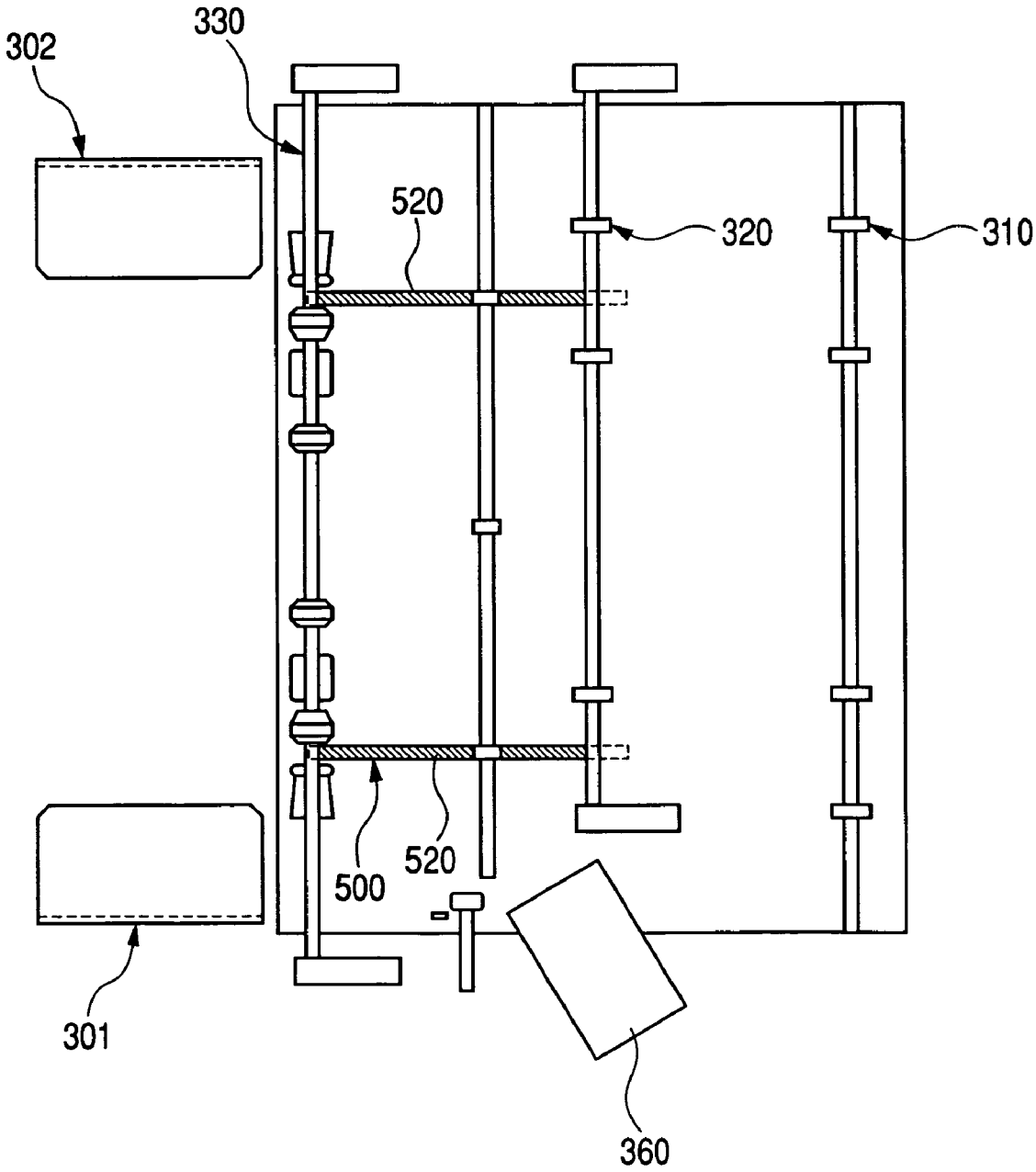
FIG. 16 is a plan view of the sheet post-processing apparatus shown in FIG. 15.

The sheet bundle discharging device 500 as bundle conveying means has a belt 520 which is stretched across pulleys 510*a* and 510*b* and is capable of rotating in the counterclockwise direction and a discharging piece 520*a* serving as a projected portion provided in this belt 520. As shown in FIG. 16, two belts 520 are provided on a front side and a back side symmetrically with respect to a center of conveyance of a sheet. As shown in FIG. 15, the discharging piece 520*a* is on standby on an upstream side of the reference wall 323.

Figure 17B:
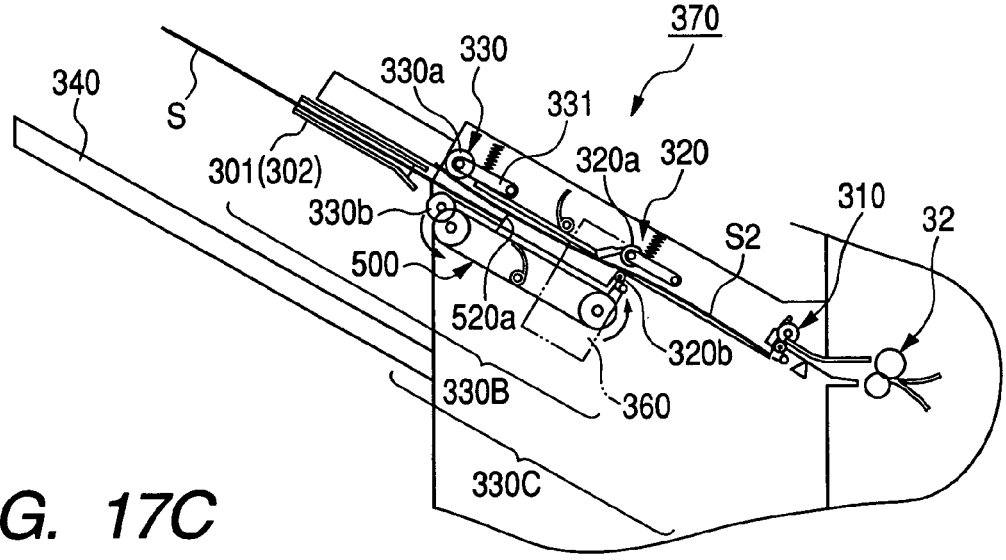
Figure 17C:
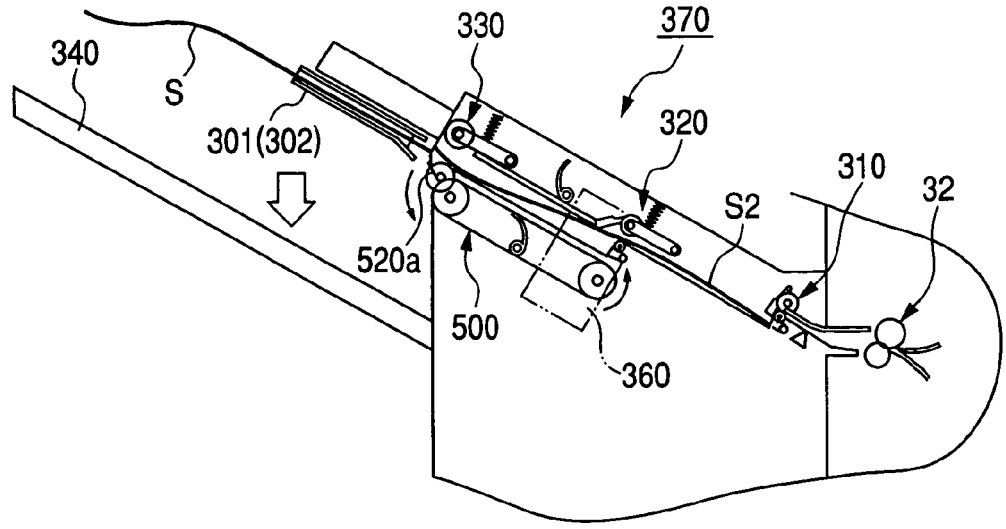

FIGS. 17A to 17C are diagrams for explaining an operation of discharging a sheet bundle stapled by the first intermediate stacking portion 300B in a state in which a sheet is stacked on the second intermediate stacking portion 300C.

As shown in FIGS. 17A and 17B, when the pulleys 510*a* and 510*b* rotate in the counterclockwise direction in a state in which the discharging upper roller 330*a* is apart from the sheet bundle, the belt 520 also rotates in the counterclockwise direction. The discharging piece 520*a* moves to the left side (the downstream side) from the reference wall 323 to come into abutment against a trailing edge surface of the sheet bundle S and move the sheet bundle to the left side.

Thereafter, when the discharging piece 520*a* moves to a position shown in FIG. 17C, the slide guide 301 on the front side and the slide guide 302 on the back side move in a direction in which an interval between the slide guides increases from the position shown in FIG. 7 according to rotation of the jogger motor (not shown). When the interval between both the side guides 301 and 302 increases to be close to or larger than a width of the sheet, the stapled sheet bundle supported by both the slide guides 301 and 302 falls as shown in FIG. 17C and stacked on the sheet stacking portion 340.

In the sheet post-processing apparatus 370 in this embodiment, from the time when the stapler 360 bounds the sheet bundle S1 of the preceding job until the time when the sheet bundle discharging device 500 conveys the sheet bundle of the preceding job to the downstream side of the stapler 360, the receiving roller pair 310 conveys the sheet S2 of the next job and the intermediate roller 320*a* of the intermediate roller pair 320 separates from the intermediate roller 320*b* and is not involved in the conveyance of the sheet S2 of the next job. Thus, even if the sheet S2 of the next job having a length from the receiving roller pair 310 to the discharging roller pair 330 is delivered while the sheet post-processing apparatus 370 is binding the sheet bundle S1 of the preceding job, the sheet post-processing apparatus 370 can receive and store the sheet S2 and enhance sheet processing efficiency.

Note that the sheet bundle discharging device 500 can discharge a sheet bundle even if the sheet bundle has a length less than the length from the receiving roller pair 310 to the discharging roller pair 330. Therefore, the discharging roller pair 330 is not always required. However, when sheets are discharged sequentially without being stapled, it is possible to discharge the sheets more efficiently with the discharging roller pair 330 than discharging the sheets with the sheet bundle discharging device 500.

In addition, since a sheet processing position is set outside a sheet conveying area, a sheet in the next job is never bundled together with a sheet in the preceding job by mistake.

(Sheet Post-processing Apparatus of a Third Embodiment)

Figure 18:
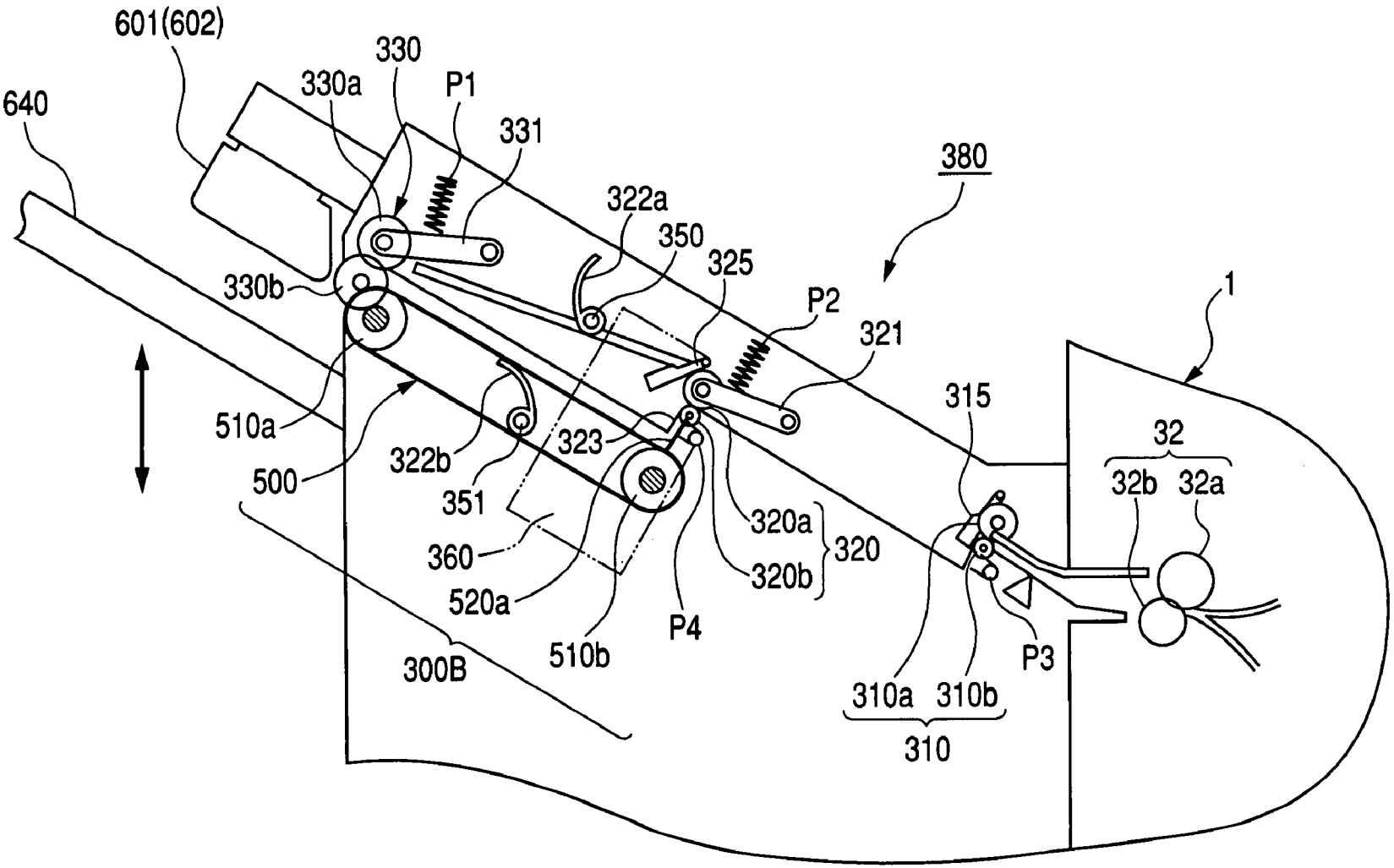
FIG. 18 is a sectional view taken along a sheet conveying direction of a sheet post-processing apparatus according to a third embodiment of the present invention.
Figure 19:
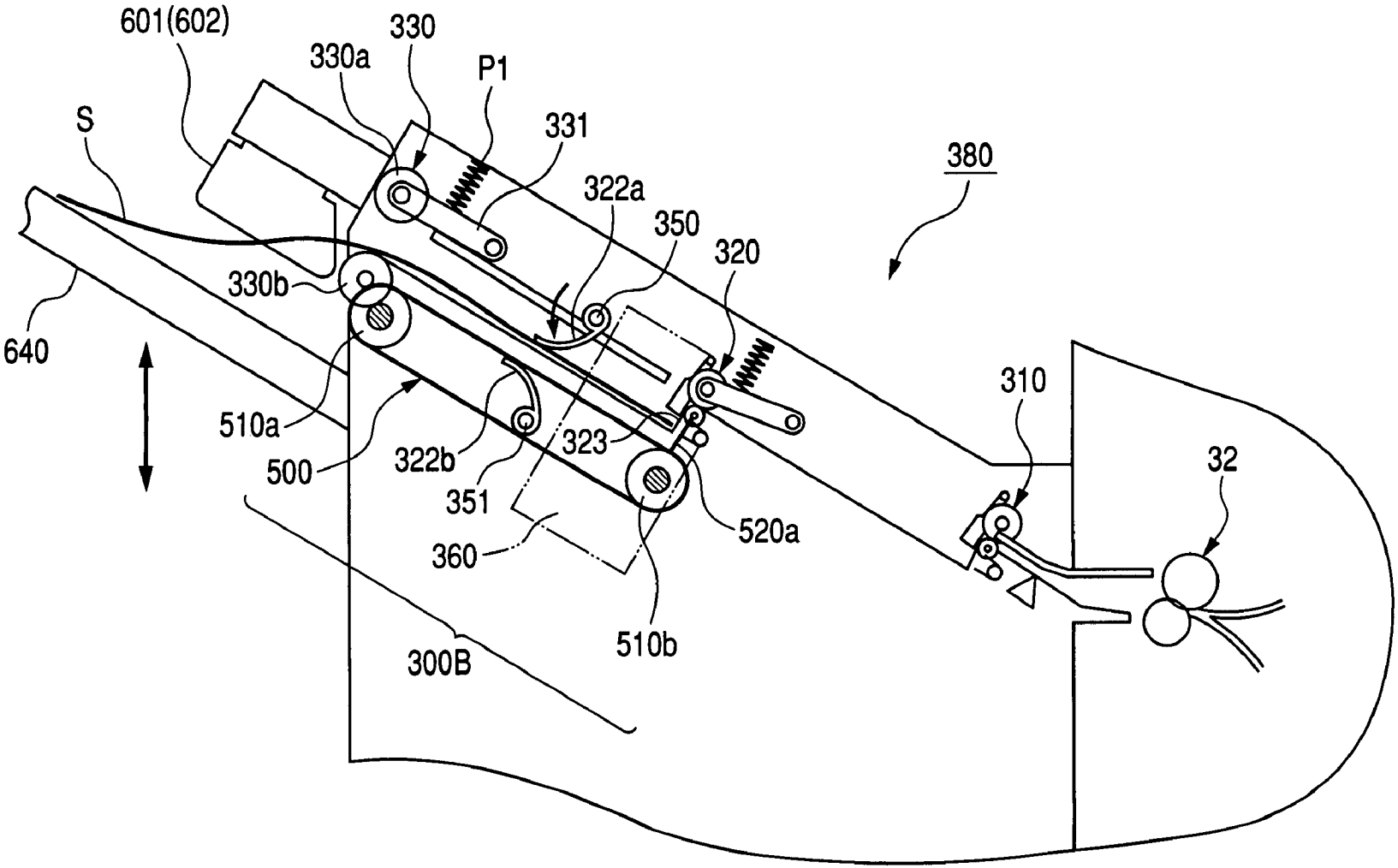
FIG. 19 is a diagram illustrative of a state in which a sheet is aligned in the sheet post-processing apparatus in FIG. 18.

FIG. 18 is a sectional view taken along a sheet conveying direction of a sheet post-processing apparatus according to a third embodiment of the present invention. FIG. 19 is a diagram of a state in which a sheet is received.

In the first embodiment, both sides of a sheet along a sheet conveying direction are supported by the slide guide 301 on the front side and the slide guide 302 on the back side and alignment in the width direction of the sheet is performed from both the sides. In a sheet post-processing apparatus 380 in this embodiment, a sheet is supported by a sheet stacking tray 640 serving as elevatable stacking means and alignment in the width direction of the sheet is performed by aligning plates 601 and 602 serving as aligning pieces.

The aligning plates 601 and 602 have a shape obtained by removing the sheet supporting pieces 301*c* and 302*c* of the slide guides 301 and 302 in the first embodiment. The aligning plates 601 and 602 guide a sheet in the conveying direction and align a width of the sheet. When the discharging upper roller 330*a* separates from the discharging lower roller 330*b*, the first intermediate stacking portion 300B is formed between the sheet stacking tray 640 and the intermediate roller pair 320. Note that the sheet bundle discharging device 500 is not always required.

A sheet aligning operation will be explained with reference to FIG. 19.

When the discharging upper roller 330*a* separates from the discharging lower roller 330*b*, an upstream end of a sheet stacked on the first intermediate stacking portion 300B, which is formed between the sheet stacking tray 640 and the intermediate roller pair 320, is brought into abutment against the reference wall 323 by the upper paddle 322*a* and aligned. A width of the sheet is aligned by the aligning plates 601 and 602.

An aligning operation position of the aligning plates 601 and 602 in the width direction of the sheet (a direction perpendicular to the sheet conveying direction) is the same as the aligning operation position of the slide guides 301 and 302 in the first embodiment.

FIG. 19 is a diagram of a case in which there is no preceding sheet bundle in the sheet stacking tray 640. The first intermediate stacking portion 300B is formed on an upper surface of the sheet stacking tray 640. However, when there is a sheet in the preceding job, the first intermediate stacking portion 300B is formed on an upper surface of the sheet in the preceding job. When a sheet is placed on the sheet stacking tray 640, an upper surface of the sheet is detected by a sheet stacking surface sensor (not shown). The sheet stacking tray 640 is lowered by an elevating mechanism such that the upper surface of the sheet can always maintain a fixed height.

According to this sheet post-processing apparatus, since a sheet is supported by the sheet stacking tray 640, the aligning plates 601 and 602 are not required to support the sheet. Thus, it is possible to further simplify the shape of the slide guides 301 and 302 in the first embodiment. In addition, since the sheet supporting pieces 301*c* and 302*c* are removed, a space for taking out a sheet is widened such that a user can easily take out the sheet.

(Sheet Post-processing Apparatus in a Fourth Embodiment)

Figure 20:
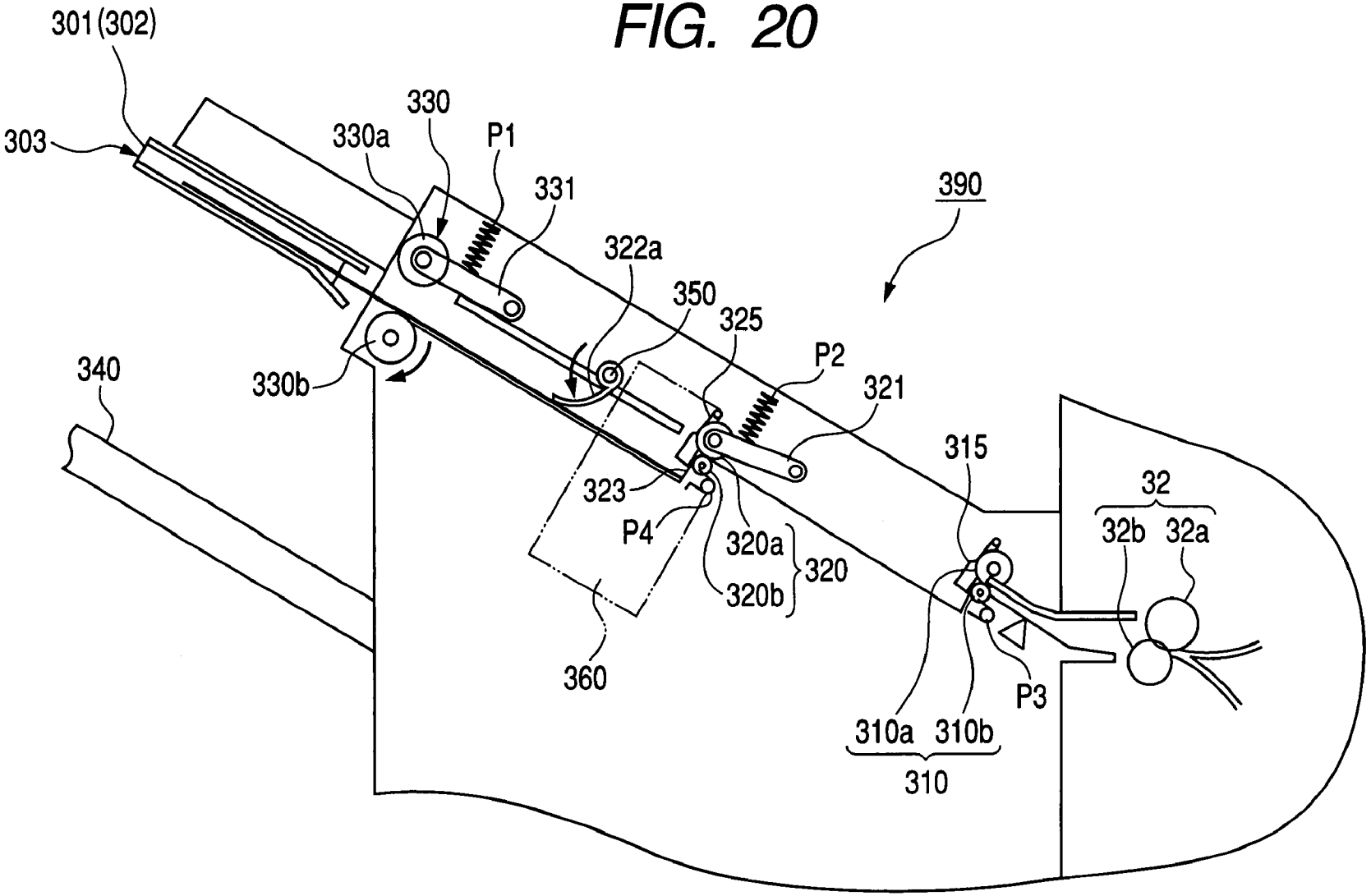
FIG. 20 is a sectional view taken along a sheet conveying direction of a sheet post-processing apparatus according to a fourth embodiment of the present invention.

In the sheet post-processing apparatuses 300, 370, and 380 in the embodiments described above, for example, as shown in FIG. 1C, the lower paddle 322*b* rotates in the clockwise direction to come into contact with a lower surface of a sheet at the bottom and feeds the sheet reversely to the upstream side to bring the sheet into abutment against the reference wall 323. It is also possible that, as in a sheet post-processing apparatus 390 in a fourth embodiment of the present invention shown in FIG. 20, the lower paddle 322*b* is removed and, in a state in which the discharging upper roller 330*a* is apart from the discharging lower roller 330*b*, the discharging lower roller 330*b* is rotated in the clockwise direction instead of the lower paddle 322*b* to feed the sheet at the bottom reversely. In this case, it is preferable that the discharging lower roller 330*b* be formed of a material with a high coefficient of friction such as rubber.

When the lower paddle 322*b* is removed and the discharging lower roller 330*b* is used instead of the lower paddle 322*b*, it is possible to simplify the structure of the sheet post-processing apparatus and reduce cost.

Note that the receiving roller pair 310, the intermediate roller pair 320, and the discharging roller pair 330 in the sheet post-processing apparatuses 300, 370, 380, and 390 are formed by rollers. However, the receiving roller pair 310, the intermediate roller pair 320, and the discharging roller pair 330 are not limited to the rollers and may be formed by a rotating belt pair.

This application claims priority from Japanese Patent Application Nos. 2004-109532 filed on Apr. 1, 2004 and 2005-029807 filed on Feb. 4, 2005, which are hereby incorporated by reference herein.

What is claimed is:

1. A sheet processing apparatus, comprising:

a first stacking portion which stacks a sheet;

an aligning device which moves in a direction intersecting with a sheet conveying direction and which aligns both sides of the sheet on the first stacking portion;

a processing unit which performs a process to the sheet aligned by the aligning device on the first stacking portion;

a second stacking portion which is located on an upstream side in the sheet conveying direction of the first stacking portion and which is capable of storing a sheet during the process; and a conveying rotary member which conveys the sheet on the second stacking portion to the first stacking portion, wherein the first stacking portion and the second stacking portion are arranged such that an upstream end in the sheet conveying direction of the sheet stacked on the first stacking portion and a downstream end in the sheet conveying direction of the sheet stored in the second stacking portion overlap each other, and the aligning device is disposed on a downstream side in the sheet conveying direction from the downstream end of the sheet stored on the second stacking portion.

2. A sheet processing apparatus according to claim 1, wherein a step is provided between the first stacking portion and the second stacking portion and a stacking surface of the second stacking portion is set higher than a stacking surface of the first stacking portion by the step.

3. A sheet processing apparatus according to claim 1, further comprising a conveying direction positioning member which receives the upstream end in the sheet conveying direction of the sheet stacked on the first stacking portion.

4. A sheet processing apparatus according to claim 2, further comprising a conveying direction positioning member which receives the upstream end in the sheet conveying direction of the sheet stacked on the first stacking portion, wherein the conveying direction positioning member is formed into the step.

5. A sheet processing apparatus according to claim 1, further comprising:

a sheet stacking portion which stacks a sheet from the first stacking portion; and a discharge member which discharges the sheet on the first stacking portion to the sheet stacking portion, wherein the discharge member is provided outside a stacking area of the second stacking portion, and the conveying rotary member is provided outside a stacking area of the first stacking portion.

6. A sheet processing apparatus according to claim 5, wherein the discharge member is a roller pair.

7. A sheet processing apparatus according to claim 5, wherein the discharge member is a rotatable belt.

8. A sheet processing apparatus according to claim 1, wherein the aligning device aligns the sheet in a position shifted by a predetermined distance in the direction intersecting with the sheet conveying direction from a position to which the sheet is conveyed by the conveying rotary member.

9. A sheet processing apparatus according to claim 8, wherein the processing unit is a stapler which binds sheets on the first stacking portion and performs binding process to the sheet aligned by the aligning device in the position shifted by the predetermined distance in the direction intersecting with the sheet conveying direction from the position to which the sheet is conveyed by the conveying rotary member.

10. A sheet processing apparatus according to claim 5, wherein the sheet stacking portion is provided below the aligning device, the aligning device has a pair of supporting portions which support both sides of the sheet, and the pair of supporting portions are movable to a first position where the pair of supporting portions approach each other to form the first stacking portion and a second position where the pair of supporting portions are apart from each other to drop and stack the sheet on the sheet stacking portion.

11. A sheet processing apparatus according to claim 3, further comprising a returning device which brings the upstream end in the sheet conveying direction of the sheet, which is conveyed onto the first stacking portion, into abutment against the conveying direction positioning member.

12. A sheet processing apparatus according to claim 11, wherein the returning device comprises an upper surface returning member which comes into abutment against an upper surface of the sheet stacked on the first stacking portion and a lower returning member which comes into abutment against a lower surface of the sheet.

13. A sheet processing apparatus according to claim 12, wherein the discharge member is a roller pair and a roller on a lower side of the roller pair serves as the lower surface returning member.

14. A sheet processing apparatus according to claim 6, wherein, in a state in which the roller pair separates, the sheet stacking portion is shiftable upwardly and downwardly, and the first stacking portion is formed by the sheet stacking portion or an upper surface of the sheet stacked on the sheet stacking portion.

15. An image forming apparatus, comprising:

an image forming unit which forms an image on a sheet; and a sheet processing apparatus which performs a process to the sheet on which the image is formed by the image forming unit, the sheet processing apparatus comprising:

a first stacking portion which stacks a sheet;

an aligning device which moves in a direction intersecting with a sheet conveying direction and which aligns both sides of the sheet on the first stacking portion;

a processing unit which performs the process to the sheet aligned by the aligning device on the first stacking portion;

a second stacking portion which is located on an upstream side in the sheet conveying direction of the first stacking portion and which is capable of storing a sheet during the process; and a conveying rotary member which conveys the sheet on the second stacking portion to the first stacking portion, wherein the first stacking portion and the second stacking portion are arranged such that an upstream end in the sheet conveying direction of the sheet stacked on the first stacking portion and a downstream end in the sheet conveying direction of the sheet stored in the second stacking portion overlap each other, and the aligning device is disposed on a downstream side in the sheet conveying direction from the downstream end of the sheet stored in the second stacking portion.

16. An image forming apparatus according to claim 15, wherein a step is provided between the first stacking portion and the second stacking portion and a stacking surface of the second stacking portion is set higher than a stacking surface of the first stacking portion by the step.

17. An image forming apparatus according to claim 15, further comprising a conveying direction positioning member which receives the upstream end in the sheet conveying direction of the sheet stacked on the first stacking portion.

18. An image forming apparatus according to claim 16, further comprising a conveying direction positioning member which receives the upstream end in the sheet conveying direction of the sheet stacked on the first stacking portion, wherein the conveying direction positioning member is formed into the step.

19. An image forming apparatus according to claim 15, further comprising:

a sheet stacking portion which stacks a sheet from the first stacking portion; and a discharge member which discharges the sheet on the first stacking portion to the sheet stacking portion, wherein the discharge member is provided outside a stacking area of the second stacking portion; and the conveying rotary member is provided outside a stacking area of the first stacking portion.

20. An image forming apparatus according to claim 15, wherein the aligning device aligns the sheet in a position shifted by a predetermined distance in the direction intersecting with the sheet conveying direction from a position to which the sheet is conveyed by the conveying rotary member.

21. An image forming apparatus according to claim 20, wherein the processing unit is a stapler which binds sheets on the first stacking portion and performs binding process to the sheet aligned by the aligning device in the position shifted by the predetermined distance in the direction intersecting with the sheet conveying direction from a position to which the sheet is conveyed by the conveying rotary member.

22. An image forming apparatus according to claim 19, wherein the sheet stacking portion is provided below the aligning device, the aligning device has a pair of supporting portions which support both sides of the sheet, and the pair of supporting portions are movable to a first position where the pair of supporting portions approach each other to form the first stacking portion and a second position where the pair of supporting portions are apart from each other to drop and stack the sheet on the sheet stacking portion.

23. An image forming apparatus according to claim 17, further comprising a returning device which brings the upstream end in the sheet conveying direction of the sheet, which is conveyed onto the first stacking portion, into abutment against the conveying direction positioning member.

* * * * *

UNITED STATES PATENT AND TRADEMARK OFFICE

CERTIFICATE OF CORRECTION

PATENT NO. : 7,386,271 B2
APPLICATION NO. : 11/087501
DATED : June 10, 2008
INVENTOR(S) : Kuwata et al.

It is certified that error appears in the above-identified patent and that said Letters Patent is hereby corrected as shown below:

ON THE TITLE PAGE:
At Item (56), References Cited, Foreign Patent Documents, "2003081517 A" should read --2003-081517 A--, and "07048064 A" should read --07-048064 A--.

COLUMN 10:
Line 8, "form" should read --from--.

COLUMN 14:
Line 41, "stored" should read --store--.

COLUMN 16:
Line 32, "bounds" should read --binds--.

COLUMN 17:
Line 54, "FIG. 1C," should read --FIG. 11C,--.

Signed and Sealed this

Second Day of December, 2008

JON W. DUDAS
*Director of the United States Patent and Trademark Office*